US007972409B2

(12) United States Patent
Fujino et al.

(10) Patent No.: US 7,972,409 B2
(45) Date of Patent: Jul. 5, 2011

(54) CEMENTED CARBIDE AND CUTTING TOOL

(75) Inventors: Asako Fujino, Kyoto (JP); Takashi Tokunaga, Satsumasendai (JP)

(73) Assignee: Kyocera Corporation, Kyoto (JP)

( * ) Notice: Subject to any disclaimer, the term of this patent is extended or adjusted under 35 U.S.C. 154(b) by 902 days.

(21) Appl. No.: 11/909,710

(22) PCT Filed: Mar. 23, 2006

(86) PCT No.: PCT/JP2006/305803

§ 371 (c)(1),
(2), (4) Date: Sep. 25, 2007

(87) PCT Pub. No.: WO2006/104004

PCT Pub. Date: Oct. 5, 2006

(65) Prior Publication Data

US 2009/0044415 A1 Feb. 19, 2009

(30) Foreign Application Priority Data

Mar. 28, 2005 (JP) ..... 2005-091740
Mar. 29, 2005 (JP) ..... 2005-095411
Dec. 13, 2005 (JP) ..... 2005-358450
Dec. 22, 2005 (JP) ..... 2005-370337

(51) Int. Cl.
*C22C 28/00* (2006.01)

(52) U.S. Cl. ..... 75/240; 75/236; 75/242; 428/698

(58) Field of Classification Search ..... None
See application file for complete search history.

(56) References Cited

U.S. PATENT DOCUMENTS 4,591,481 A * 5/1986 Lueth ..... 419/26
2005/0019614 A1* 1/2005 Miura et al. ..... 428/698

FOREIGN PATENT DOCUMENTS

JP 02-221373 9/1990

(Continued)

OTHER PUBLICATIONS

Chinese language office action and its English language translation for corresponding Chinese application 200680009887.4.

(Continued)

*Primary Examiner* — Roy King
*Assistant Examiner* — Ngoclan T Mai
(74) *Attorney, Agent, or Firm* — DLA Piper LLP (US)

(57) ABSTRACT

Disclosed is a cemented carbide comprising 5 to 10 mass % of cobalt and/or nickel, and 0 to 10 mass % of at least one selected from a carbide (except for tungsten carbide), a nitride and a carbonitride of at least one selected from the group consisting of metals of groups 4, 5 and 6 of the Periodic Table, the balanced amount of tungsten carbide, a hard phase comprising mainly tungsten carbide particles, and containing β particles of at least one selected from the carbide, the nitride and the carbonitride, and the hard phase being bonded through a binder phase comprising mainly cobalt and/or nickel, wherein a mean particle size of the tungsten carbide particles is 1 μm or less, and the cemented carbide having a sea-island structure in which plural binder-phase-aggregated portions composed mainly of cobalt and/or nickel are scattered in the proportion of 10 to 70 area % based on the total area on the surface of the cemented carbide. The cemented carbide is excellent in wear resistance and fracture resistance.

6 Claims, 2 Drawing Sheets

FOREIGN PATENT DOCUMENTS

| | | | |
|---|---|---|---|
| JP | 08-225877 | | 9/1996 |
| JP | 10-225804 | | 8/1998 |
| JP | 10225804 | A | 8/1998 |
| JP | 11-181540 | | 7/1999 |
| JP | 2001-115229 | | 4/2001 |
| JP | 2003-001505 | | 1/2003 |
| JP | 2004-059946 | | 2/2004 |
| JP | 2004-506525 | | 3/2004 |
| WO | WO 02/14569 | | 2/2002 |

OTHER PUBLICATIONS

German language office action and its English language translation for corresponding German application 112006000769.6-45.

Japanese language office action dated Sep. 14, 2010 and its English language translation for corresponding Japanese application 2007510428 lists the reference above.

* cited by examiner

CEMENTED CARBIDE AND CUTTING TOOL

TECHNICAL FIELD

The present invention relates to a cemented carbide used in cutting tools, sliding members and wear resistant members, and a cutting tool using the same.

BACKGROUND ART

A cemented carbide used widely as cutting tools for cutting metal, siding members and wear resistant members includes, for example, a WC—Co alloy in which a hard phase composed mainly of tungsten carbide (WC) particles is bonded through a binder phase composed mainly of cobalt (Co), and a WC—Co alloy in which a hard phase called as a β phase (B-1 type solid solution phase) composed of β particles (B-1 type solid solution) composed of carbide, nitride and carbonitride of metals of groups 4, 5 and 6 of the Periodic Table is dispersed. These cemented carbides are utilized as a material for cutting tool which is used to cut general steels such as carbon steel, alloy steel and stainless steel.

In a predetermined depth zone extending from the surface of a cemented carbide from the inside, a binder-phase-riched layer including a high content of Co as a binder phase component exists. It is disclosed that, when a hard coating is formed on the surface of the cemented carbide by forming the binder-phase-riched layer on the entire surface of the cemented carbide, fracture resistance of the cemented carbide is improved (see, for example, patent literature 1).

However, in the cemented carbide disclosed in patent literature 1, although fracture resistance is improved when coated with the hard coating, the hard coating may sometimes peel off, and sufficient adhesion between the cemented carbide substrate and the hard coating may not be achieved. Also, when no hard coating is formed, hardness of the entire surface of the cemented carbide decreases and large plastic deformation occurs on the surface, and therefore cutting resistance increases and the temperature of a cutting edge increases, thus causing a problem that a binder phase existing in the cutting edge gradually reacts with a work material, namely, low welding resistance. In a cemented carbide composed of fine particles in which WC particles in the cemented carbide has a particle size of 1 μm or less, thermal conductivity tends to decrease to cause a problem such as welding. As a result, because of the work material welded to the cutting edge, chipping and sudden fractures are likely to occur, and thus a further improvement in welding resistance on the surface of an alloy has been required.

Patent literature 2 describes that, in a titanium-based cermet made of a nitrogen-containing sintered hard alloy, when the entire surface of the cermet includes a high content of a binder phase of Co or nickel (Ni), or a multi-layered structure exudation layer including a high content of tungsten carbide (WC) is formed, thermal conductivity on the surface of the cermet is improved and thus it is possible to suppress thermal cracking caused by difference between the temperature of the surface increased as a result of cutting and a low temperature inside.

However, even if an exudation layer is formed on the entire surface of a cermet as disclosed in patent literature 2, hardness of the entire surface decreases and large plastic deformation occurs on the surface, and therefore cutting resistance increases and the temperature of a cutting edge increases, thus causing a problem that a binder phase existing in the cutting edge gradually reacts with a work material. Also, even if a hard coating is formed on the surface of a cermet comprising an exudation layer formed on the entire surface, the hard coating may peel off because of insufficient adhesion between the cermet and the hard coating.

On the other hand, in case of cutting a titanium (Ti) alloy used for aircraft industry, a cemented carbide tool comprising no hard coating formed thereon so as to prevent contamination of the worked surface is used. A Ti alloy has low thermal conductivity and high strength and is therefore known as a hard-to-cut material and, when a conventional cemented carbide tool is used, there arose a problem such as very rapid wear proceeding and short tool life.

Patent literature 3 describes that, when a sintered cemented carbide is subjected again to a heat treatment under a Co atmosphere to obtain a cutting tool made of a cemented carbide whose surface is coated with a very thin Co layer having a thickness of 8 μm or less and a Ti alloy is cut while spraying a coolant under high pressure using this cutting tool, tool life can be prolonged.

However, in the cemented carbide described in patent literature 3, although machinability of the Ti alloy is improved by the Co thin layer formed on the surface of the cemented carbide, if the temperature of the Co thin layer becomes higher during cutting, the Co thin layer may be welded to a work material. Therefore, the work material must be machined while spraying a coolant over the portion to be machined under high pressure, and thus there arises a problem that a large-scaled equipment for spraying a coolant under high pressure is required. Also, the Co thin layer is likely to be worn because of insufficient hardness, and thus there arises a problem that sufficient tool life is not obtained in case of machining at a high cutting speed.

Also, in case of cutting a Ni-based heat resistant alloy such as Inconel or Hastelloy, an iron (Fe)-based heat resistant alloy such as Incoloy, and a heat resistant alloy such as Co-based heat resistant alloy, a cutting tool comprising a cemented carbide and a hard coating formed on the surface of the cemented carbide is used. However, such a heat resistant alloy has high strength at high temperature, and thus there arises a problem that wear of the cutting tool proceeds at an initial stage.

On the other hand, various studies on an improvement in characteristics of the cemented carbide have been made and materials having higher hardness, higher toughness or higher strength have been developed according to the purposes. For example, patent literature 4 describes that, when a cemented carbide is produced by adjusting the content of a binder phase so as to controlling saturation magnetization to 1.62 $\mu Tm^3/kg$ or less per 1 weight % of cobalt (Co) and a coercive force to 27.8 to 51.7 kA/m while suppressing segregation of a Co component, fractures in the cemented carbide decrease to impart high deflective strength, and thus a cutting tool suited for drilling or milling can be obtained.

Also, patent literature 5 describes that when using, as a cemented carbide used generally in the cutting field and wear resistant parts, a high toughness cemented carbide having a fine particle structure in which saturation magnetization per 1 weight % of cobalt (Co) is 1.44 to 1.74 $\mu Tm^3/kg$, a coercive force is 24 to 52 kA/m and a mean particle size of less than 1 μm, and the number of coarse WC particles (hard phase) having a particle size of 2 μm or more is only 5 or less, it becomes possible to achieve high toughness and to avoid sudden fracture event.

However, the cemented carbides having a coercive force of 24 kA/m or more disclosed in patent literature 4 and patent literature 5 is not suited for severe cutting such as cutting of a titanium (Ti) alloy or a heat resistant alloy because of too thin binder phase and too high hardness, and thus there arises a problem that sufficient fracture resistance cannot be obtained because of insufficient toughness of the cemented carbide.

Patent literature 6 describes that, by controlling a mean particle size of a cemented carbide within a range from 0.2 to 0.8 μm, saturation magnetization theoretical ratio within a range from 0.75 to 0.9, and a coercive force within a range from 200 to 340 Oe, the resulting cemented carbide has improved toughness and hardness and is best suited for use as a material of a precision die.

However, in the cemented carbide described in patent literature 6, since a hard phase has too small particle size, fracture resistance enough to be used for severe cutting of a Ti alloy or a heat resistant alloy cannot be obtained. Also, in the method disclosed in patent literature 6, since the cemented carbide is sintered by spark plasma sintering, there arises a problem such as low productivity and high cost.

Patent literature 7 describes that a cemented carbide comprising about 10.4 to about 12.7 weight % of a binder phase component and about 0.2 to about 1.2 weight % of Cr, which has a coercive force of about 120 to 240 Oe, saturation magnetization of about 143 to about 223 $\mu Tm^3/kg$ of cobalt (Co) and a particle size of tungsten carbide (WC) particles (hard phase) of 1 to 6 μm, and is also excellent in toughness and strength and has high fracture resistance, and is useful as a cutting tool for milling a Ti alloy, a steel or a cast iron.

However, the cemented carbide described in patent literature 7 has high fracture resistance because of high content of the binder phase, but has not enough wear resistance to cut a Ti alloy or a heat resistant alloy. Also, when the content of the binder phase is too large, reactivity with a work material increases and a Ti alloy is likely to be welded to a cutting edge of a cutting tool, and thus there arises a problem such as deterioration of forming accuracy such as deterioration of quality of the worked surface, and tool damages such as chipping of cutting edge and abnormal wear.

Patent literature 1: Japanese Unexamined Patent Publication No. 2-221373

Patent literature 2: Japanese Unexamined Patent Publication No. 8-225877

Patent literature 3: Japanese Unexamined Patent Publication No. 2003-1505

Patent literature 4: Japanese Unexamined Patent Publication No. 2004-59946

Patent literature 5: Japanese Unexamined Patent Publication No. 2001-115229

Patent literature 6: Japanese Unexamined Patent Publication No. 1999-181540

Patent literature 7: Published Japanese Translation No. 2004-506525 of the PCT Application

DISCLOSURE OF THE INVENTION

Problems to be Solved by the Invention

A main object of the present invention is to provide a cemented carbide which has improved plastic deformation resistance and welding resistance on the surface of the cemented carbide, and is excellent in wear resistance and fracture resistance, and to provide a long tool life cutting tool.

Another object of the present invention is to provide a cemented carbide which is excellent in flexural strength, and to provide a long tool life cutting tool.

Still another object of the present invention is to provide a cemented carbide which is excellent in wear resistance and fracture resistance by increasing hardness without decreasing toughness, and to provide a long tool life cutting tool.

Means for Solving the Problems

The present inventors have intensively studied so as to achieve the above objects and found that, when plural binder-phase-aggregated portions formed through aggregation of binder phases are scattered on the surface of a cemented carbide to form a sea-island structure, and the proportion of the binder-phase-aggregated portions is adjusted within a range from 10 to 70 area % relative to the total area on the surface of the cemented carbide, heat release (thermal diffusivity) properties on the surface of the cemented carbide are improved and plastic deformation resistance and welding resistance are improved, and thus a cemented carbide having excellent wear resistance and fracture resistance is obtained. The present invention has been completed based on this novel finding.

Namely, the cemented carbide of the present invention comprising: 5 to 10 mass % of cobalt and/or nickel; 0 to 10 mass % of at least one selected from a carbide (except for tungsten carbide), a nitride and a carbonitride of at least one selected from the group consisting of metals of groups 4, 5 and 6 of the Periodic Table; and the balanced amount of tungsten carbide, a hard phase comprising mainly tungsten carbide particles, and containing β particles of at least one selected from the carbide, the nitride and the carbonitride, and the hard phase being bonded through a binder phase comprising mainly cobalt and/or nickel, wherein a mean particle size of the tungsten carbide particles is 1 μm or less, and the cemented carbide having a sea-island structure in which plural binder-phase-aggregated portions comprising mainly cobalt and/or nickel are scattered in the proportion of 10 to 70 area % relative to the total area on the surface of the cemented carbide.

Also, the present inventors have intensively studied so as to achieve the above objects and found that, when the cemented carbide comprising a binder-phase-riched layer having a thickness of 0.1 to 5 μm on the surface, and also satisfies the following relationship: $0.02 \leqq I_{Co}/(I_{WC}+I_{Co}) \leqq 0.5$ where $I_{WC}$ denotes a (001) plane peak intensity of the tungsten carbide (WC), and $I_{Co}$ denotes a (111) plane peak intensity of cobalt (Co) and/or nickel (Ni) in an X-ray diffraction pattern of the surface, the resulting cemented carbide is excellent in flexural strength and, when the cemented carbide is used for cutting tool, even under conventional cutting conditions where a special device such as coolant under high pressure is not used in case of machining a heat resistant alloy such as Ti alloy, proceeding of wear and occurrence of chipping can be suppressed and tool life can be prolonged. The present invention has been completed based on this novel finding.

Namely, the cemented carbide of the present invention comprising: 5 to 10 mass % of cobalt and/or nickel; 0 to 10 mass % of at least one selected from a carbide (except for tungsten carbide), a nitride and a carbonitride of at least one selected from the group consisting of metals of groups 4, 5 and 6 of the Periodic Table; and the balanced amount of tungsten carbide, a hard phase comprising mainly tungsten carbide particles, and containing β particles of at least one selected from the carbide, the nitride and the carbonitride, and the hard phase being bonded through a binder phase comprising mainly cobalt and/or nickel, wherein the cemented carbide comprising a binder-phase-riched layer having a thickness of 0.1 to 5 μm on the surface, and also satisfies the following relationship: $0.02 \leqq I_{Co}/(I_{WC}+I_{Co}) \leqq 0.5$ where $I_{WC}$ denotes a (001) plane peak intensity of the tungsten carbide, and $I_{Co}$ denotes a (111) plane peak intensity of cobalt and/or nickel in an X-ray diffraction pattern of the surface.

Also, the present inventors have intensively studied so as to achieve the above objects and found that, when hardness of the cemented carbide is increased by properly controlling the particle size of the binder phase in the cemented carbide, the thickness of the binder phase, and the carbon content, and also the content of oxygen in the cemented carbide is adjusted, the resulting cemented carbide is excellent in both fracture resistance and wear resistance against cutting of a Ti alloy and a heat resistant alloy and, when the cemented carbide is used as a cutting tool, the resulting cutting tool is a long tool life cutting tool which can be used for cutting a Ti alloy and a heat resistant alloy. The present invention has been completed based on this novel finding.

Namely, the cemented carbide of the present invention comprising: 5 to 7 mass % of cobalt and/or nickel; 0 to 10 mass % of at least one selected from a carbide (except for tungsten carbide), a nitride and a carbonitride of at least one selected from the group consisting of metals of groups 4, 5 and 6 of the Periodic Table; and the balanced amount of tungsten carbide, a hard phase comprising mainly tungsten carbide particles, and containing β particles of at least one selected from the carbide, the nitride and the carbonitride, and the hard phase being bonded through a binder phase comprising mainly cobalt and/or nickel, wherein a mean particle size of the hard phase is 0.6 to 1.0 μm, saturation magnetization is 9 to 12 $\mu Tm^3/kg$, a coercive force is 15 to 25 kA/m, and the oxygen content is 0.045 mass % or less.

The cutting tool of the present invention is a cutting tool used in a cutting operation with a cutting edge, which is formed along a ridge where a flank face and a rake face thereof meet, pressed against a work material, the cutting edge comprising the above cemented carbide.

Effects of the Invention

According to the cemented carbide of the present invention, since plural binder-phase-aggregated portions formed through aggregation of binder phases are scattered on the surface of a cemented carbide to form a sea-island structure and the proportion of the binder-phase-aggregated portions is adjusted within a range from 10 to 70 area % relative to the total area on the surface of the cemented carbide, plastic deformation on the surface of the cemented carbide is suppressed and also welding resistance on the surface of the cemented carbide is improved. As a result, the effect of improving wear resistance and fracture resistance is exerted. Therefore, a cutting tool comprising a cutting edge composed of the cemented carbide can exhibit excellent wear resistance and fracture resistance.

According to another cemented carbide of the present invention, since the cemented carbide comprises a binder-phase-riched layer having a thickness of 0.1 to 5 μm on the surface and also satisfies the following relationship: $0.02 \leqq I_{Co}/(I_{WC}+I_{Co}) \leqq 0.5$ where $I_{WC}$ denotes a (001) plane peak intensity of the tungsten carbide (WC), and $I_{Co}$ denotes a (111) plane peak intensity of cobalt (Co) and/or nickel (Ni) in an X-ray diffraction pattern of the surface, the resulting cemented carbide is excellent in flexural strength and, when the cemented carbide is used for cutting tool, even under conventional cutting conditions where a special device such as coolant under high pressure is not used in case of machining a heat resistant alloy such as Ti alloy, proceeding of wear and occurrence of chipping can be suppressed and tool life can be prolonged.

According to still another cemented carbide of the present invention, since the content of the binder phase, the mean particle size of the hard phase, magnetic characteristics of saturation magnetization and a coercive force Hc, and the content of oxygen in the cemented carbide are controlled within each predetermined range, it is possible to properly control the thickness of the binder phase bonding between tungsten carbide (WC) particles (so-called mean free path) and to properly control the content of the metal component such as tungsten (W) and carbon, which constitute the hard phase, to be dissolved in the binder phase to form a solid solution, and thus the resulting cemented carbide has high toughness and also has high hardness regardless of a small amount of the binder phase. Because of low oxygen content, when the cemented carbide is used in a cutting tool, even if the temperature of the cutting edge becomes higher during cutting, the binder phase suppresses a decrease in a coercive force for bonding a hard phase, and thus making it possible to suppress a decrease in strength of the cemented carbide. As a result, it is possible to obtain a cutting tool made of a cemented carbide, which is suited for cutting a Ti alloy and a heat resistant alloy.

PREFERRED EMBODIMENTS FOR CARRYING OUT THE INVENTION

<Cemented Carbide>

First Embodiment

Figure 1:
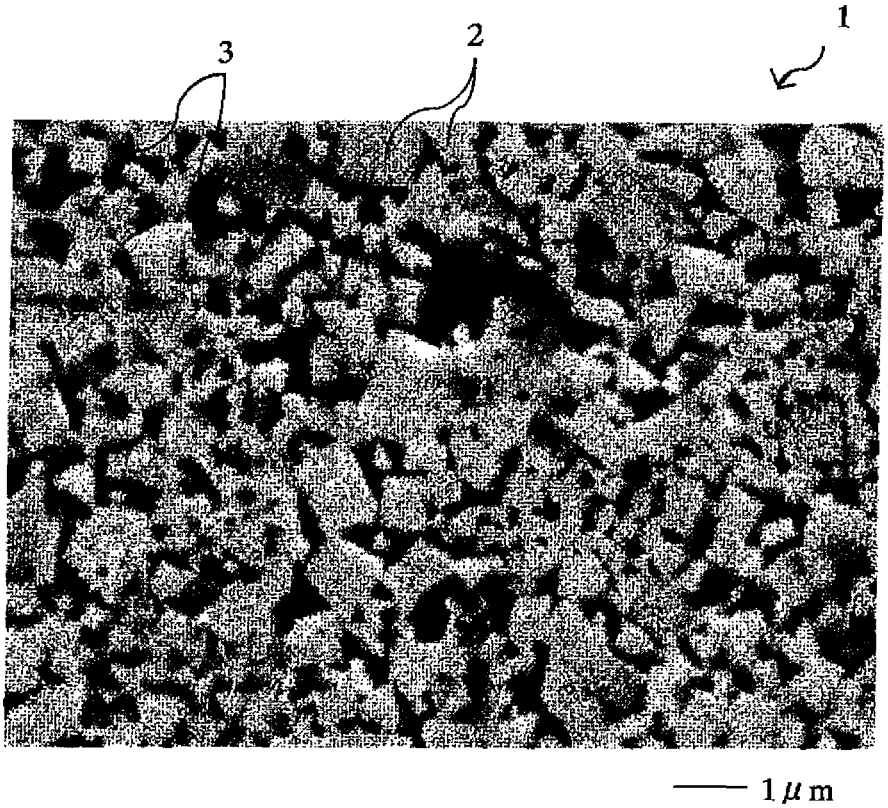
FIG. 1 is an enlarged image, which is observed by a scanning electron microscope, of the surface of a cut sample of a cemented carbide according to a first embodiment of the present invention, the cut sample being obtained by cutting the cemented carbide and polishing the cut surface.
Figure 2:
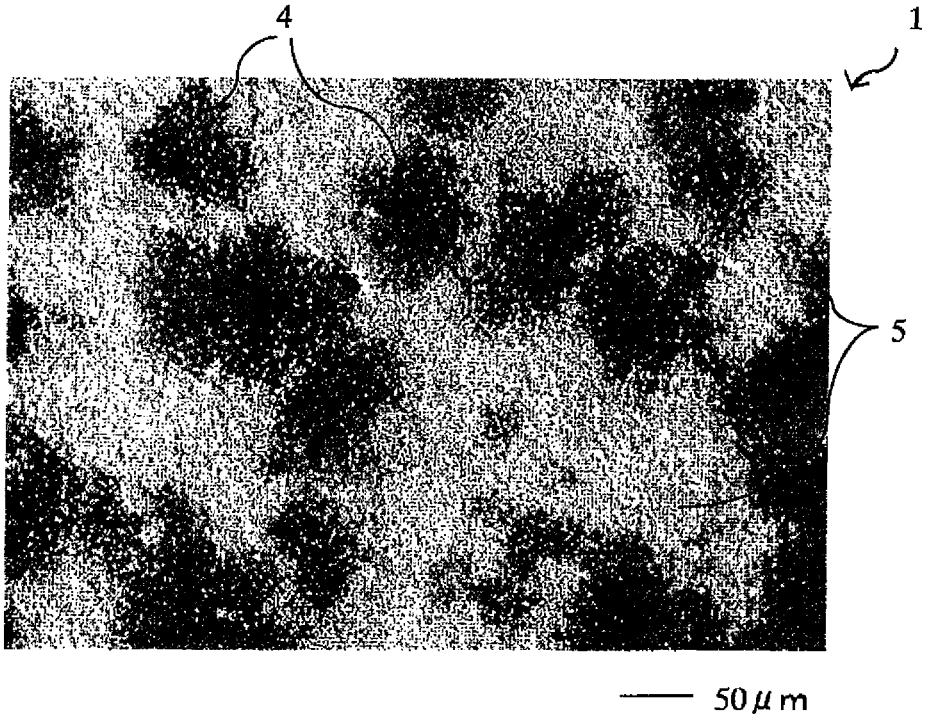
FIG. 2 is an enlarged image, which is observed by a scanning electron microscope, of the surface of a cemented carbide according to a first embodiment of the present invention.

The cemented carbide according to the first embodiment of the present invention will now be described in detail with reference to the accompanying drawing. FIG. 1 is an enlarged image (magnification: 10,000 times), which is observed by a scanning electron microscope, of the surface of a cut sample of a cemented carbide according to the present embodiment, the cut sample being obtained by cutting the cemented carbide and polishing the cut surface, and shows a state of a structure in the cemented carbide. FIG. 2 is an enlarged image (magnification: 200 times), which is observed by a scanning electron microscope, of the surface of a cemented carbide according to the present embodiment.

As shown in FIG. 1, this cemented carbide 1 is obtained by bonding a hard phase 2 through a binder phase 3. Specifically, the composition of the cemented carbide 1 comprises 5 to 10 mass % of Co and/or Ni, and 0 to 10 mass % of at least one selected from a carbide (except for WC), a nitride and a carbonitride of at least one selected from the group consisting of metals of groups 4, 5 and 6 of the Periodic Table, the balanced amount of WC.

The hard phase 2 is mainly composed of a hard phase of WC particles and optionally contains a hard phase (β phase) composed of at least one kind of β particles selected from the carbide, the nitride and the carbonitride. The binder phase 3 is mainly composed of Co and/or Ni. In the binder phase 3, in addition to Co and/or Ni, elements of groups 4, 5 and 6 of the Periodic Table may be dissolved to form a solid solution, and also unavoidable impurities such as carbon, nitrogen and oxygen may be included. Specific form of the hard phase include (1) a structure composed only of WC and (2) a structure in which WC and β particles (B-1 type solid solution) in a proportion of 10 mass % relative to the entire cemented carbide coexist, and any structure may be employed. The β particles (B-1 type solid solution) may exist alone in the form of the carbide, the nitride or the carbonitride, or may be exist as a mixture of two or more kinds of them. Also, in the β particles (B-1 type solid solution), a W element may be dissolved to form a solid solution.

The mean particle size of WC particles constituting the hard phase 2 is 1 μm or less. Consequently, strength and wear resistance of the cemented carbide 1 can be enhanced. As described above, in so-called fine cemented carbide particles in which WC particles have a mean particle size of 1 μm or less, the thickness of the binder phase 3, which bonds the respective WC particles, decreases and thermal conductivity tends to become worse. However, in the present embodiment, even in case of fine cemented carbide particles, the surface of the cemented carbide 1 is specifically constituted as described hereinafter, and thus high heat release properties can be imparted. Also, in the case of fine cemented carbide particles, sinterability of the cemented carbide 1 may deteriorate, resulting in insufficient sintered state. Therefore, in case of coating with a hard coating, an adhesion force of the coating tends to vary. However, as described hereinafter, it is possible to coat with the hard coating while maintaining a high adhesion force. The lower limit of the mean particle size is preferably 0.4 μm or more in view of maintaining toughness of a base material.

In the present embodiment, as shown in FIG. 2, plural binder-phase-aggregated portions 4 formed through aggregation of binder phases 3 are scattered on the surface of the cemented carbide 1 to form a sea-island structure and the proportion, as shown in FIG. 1. Consequently, since welding resistance of the surface of the cemented carbide 1 is improved by binder-phase-aggregated portions 4 (island portions), fracture resistance of the cemented carbide 1 is improved. Furthermore, since deterioration of wear resistance is suppressed by a normal portion 5 (sea portion) other than binder-phase-aggregated portions 4, a long tool life cutting tool is obtained when the cemented carbide 1 is applied to a cutting tool described hereinafter.

The state where plural binder-phase-aggregated portions 4 are scattered does not mean the state where the binder-phase-aggregated portions 4 exist on the entire surface, but means the sate where it is possible to confirm by visual or microscopic observation that the binder-phase-aggregated portions 4 and the cemented carbide portion (normal portion) 5 of WC particles and the binder phase other than the binder-phase-aggregated portions 4 coexist. Particularly in the present embodiment, in order to enhance heat release properties of the binder-phase-aggregated portions 4, an island-shaped structure in which the binder-phase-aggregated portions 4 are independently dispersed on the surface in the normal portion 5 (white color) as a matrix, namely, a sea-island structure in which the normal portion 5 constitutes a sea portion and the binder-phase-aggregated portions 4 constitute island portions are formed.

On the other hand, in case the binder-phase-aggregated portions 4 does not exist on the surface of the cemented carbide 1 and the cemented carbide has a uniform structure, heat generated locally on the surface of the cemented carbide 1 is not released and the surface is locally heated to high temperature because of low heat release properties on the surface of the cemented carbide 1. As a result, the portion heated to high temperature locally may deteriorate and, when used as a cutting tool, a work material is welded to the cutting edge heated to high temperature. Also, sufficient toughness is not obtained and thus sudden fractures and chipping occur. To the contrary, when the cemented carbide comprises a binder-phase-riched layer and the content of the binder phase 3 on the entire surface of the cemented carbide 1 is large, large plastic deformation cemented carbide 1 occurs on the surface and welding resistance deteriorates.

The proportion of the area of binder-phase-aggregated portions 4 on the surface of the cemented carbide 1 is 10 to 70 area %, and preferably 20 to 60 area %. When plural binder-phase-aggregated portions 4 are scattered, the above effect can be obtained. To the contrary, when the proportion of the area of the binder-phase-aggregated portions 4 is less than 10 area % relative to the total area of the cemented carbide 1, welding resistance deteriorates because of poor heat release properties, and thus chipping and fracture are caused by welding. When the proportion of the area exceeds 70 area %, the proportion of metal increases and hardness on the surface of the cemented carbide 1 decreases, and thus plastic deformation resistance deteriorates.

As described hereinafter, the area % of the binder-phase-aggregated portions 4 is a value obtained by observing a secondary electron image (200 times), as shown in FIG. 2, of the arbitrary surface of the cemented carbide 1 using a scanning electron microscope, measuring the area of binder-phase-aggregated portions 4 with respect to the arbitrary zone measuring 1 mm×1 mm, and calculating an existing ratio (area proportion of the binder-phase-aggregated portions 4 in the vision zone). The number of the binder-phase-aggregated portions measured is 10 or more and the average value is calculated.

The total content of Co and Ni is 15 to 70 mass %, and preferably 20 to 60 mass %, relative to the total amount of the metal elements on the surface of the cemented carbide 1. Consequently, it is possible to enhance toughness on the surface of the cemented carbide 1 and to improve plastic deformation resistance. Also, a hard coating described hereinafter is coated on the surface of the cemented carbide 1, fracture resistance of the coating can be improved.

A ratio of the total content m1 of Co and Ni in the binder-phase-aggregated portions 4 to the total content m2 of Co and Ni in the normal portion 5 other than the binder-phase-aggregated portions 4, (m1/m2 ), is preferably 2 to 10. Consequently, plastic deformation resistance and welding resistance on the surface of the cemented carbide 1 are more improved. The ratio (m1/m2 ) is preferably 2 or more because heat release properties are improved, and the ratio is preferably 10 or less because position resistance is excellent. The ratio (m1/m2 ) is preferably 3 to 7.

The average diameter of the binder-phase-aggregated portions 4 is 10 to 300 μm, and preferably 50 to 250 μm, because heat release properties can be enhanced by improving thermal conductivity and surely securing a path contributing to heat release properties. In case of coating with the hard coating, an adhesion force of the hard coating can be improved. The average diameter of the binder-phase-aggregated portions 4 is a diameter of a circle when the surface of the cemented carbide 1 is observed by a microscope and each of binder-phase-aggregated portions 4 is specified, and then the area of each of binder-phase-aggregated portions 4 and the average area are calculated using a LUZEX method and the average area is expressed in terms of a circle with the same area. In case of the microscopic observation, any one of a metallurgical microscope, a digital microscope, a scanning electron microscope and a transmission electron microscope can be used and a suitable one can be selected according to the size of the binder-phase-aggregated portions 4.

The binder-phase-aggregated portions 4 preferably exist in the depth zone extending from the surface of the cemented carbide 1 to 5 μm depth because heat generated on the surface of the cemented carbide 1 can be securely released and also plastic deformation resistance in a work material on the surface of the cemented carbide 1 can be enhanced The amount of the component of the binder phase 3 on the cemented carbide 1 is preferably 15 to 70 mass % because fracture resistance of the surface of the cemented carbide 1 can be improved without deteriorating wear resistance and welding resistance. In case of forming a hard coating on the surface of the cemented carbide 1, fracture resistance of the coating can be improved. In case of measuring the component of the binder phase 3 on the surface of the cemented carbide 1, a surface analysis method such as X-ray microanalyzer (Electron Probe Micro-Analysis: EPMA) or Auger Electron Spectroscopy (AES) can be used.

On the other hand, the content of the binder phase 3 in the cemented carbide 1 is preferably 6 to 15 mass % because the occurrence of sintering failure of the cemented carbide 1 can be prevented and also wear resistance of the cemented carbide 1 can be secured and plastic deformation can be suppressed. The inside of the cemented carbide 1 means the depth zone extending the surface of the cemented carbide 1 to the depth of 300 μm or more. In case of forming the hard coating on the surface of the cemented carbide 1, the inside of the cemented carbide means the depth zone extending from the interface between the hard coating and the cemented carbide 1, excluding the hard coating, to the depth of 300 μm or more towards the center of the cemented carbide 1.

The content of the binder phase 3 in the cemented carbide 1 can be measured in the following procedure. Namely, the structure of the cross section of the cemented carbide 1 is observed, for example, surface analysis is carried out with respect to the arbitrary zone measuring 30 μm×30 μm extending from the surface to the depth of 300 μm or more towards the center of the cemented carbide in the cross section of the cemented carbide 1 using a X-ray microanalyzer (EPMA), and then the content of the binder phase can be measured as the average value of the total content of Co and Ni in the zone.

The cemented carbide 1 preferably contains chromium (Cr) and/or vanadium (V) because the growth of WC particles during sintering is prevented and decrease in hardness is suppressed, and thus deterioration of wear resistance can be prevented. Each content of Cr and V is preferably 0.01 to 3 mass % and the total content of Cr and V is preferably 0.1 to 6 mass %. Particularly, Cr is effective to enhance sinterability of the cemented carbide 1 and to suppress corrosion of the binder phase 3, thereby enhancing fracture resistance.

Figure 3:
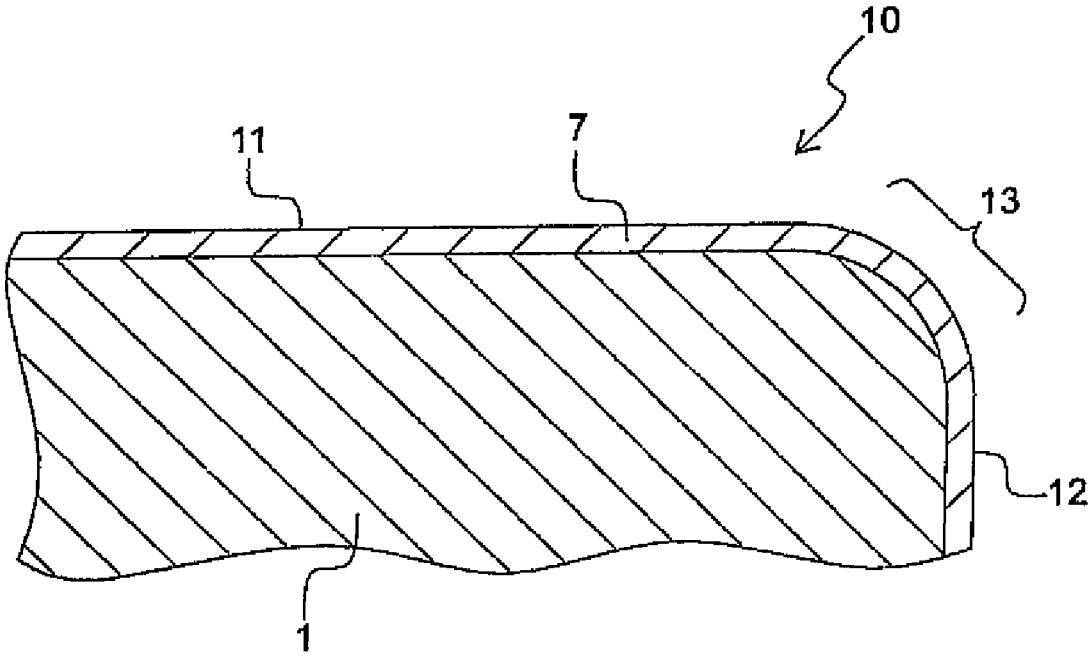
FIG. 3 is a schematic sectional view for explaining a hard coating according to a first embodiment of the present invention

In the present embodiment, the surface of the cemented carbide 1 may be coated with a hard coating. The case of coating the hard coating on the surface of the cemented carbide 1 will now be described in detail, by way of example in which the cemented carbide 1 is applied to a cutting tool described hereinafter, with reference to the accompanying drawings. FIG. 3 is a schematic sectional view for explaining a hard coating of the present embodiment.

As shown in FIG. 3, this cutting tool 10 comprises a cemented carbide 1 as a substrate, and a cutting edge 13 is formed along a ridge where a flank face 12 and a rake face 11 thereof meet, and a cutting operation is carried out by pressing the cutting edge 13 against a work material (not shown). Then, a surface coating 7 is coated on the surface of the cemented carbide 1. When the hard coating 7 is coated on the surface of the cemented carbide 1, since an adhesion force of the hard coating 7 is improved, the hard coating 7 is less likely to peel off from the surface of the cemented carbide 1 and fracture resistance is improved. As described above, because of high heat release properties on the surface of the cemented carbide 1, heat release properties on the surface of the hard coating 7 are becomes higher and also welding resistance on the surface of the hard coating 7 is improved. As a result, the resulting cemented carbide 1 is excellent in fracture resistance and wear resistance.

The reason why an adhesion force of the hard coating 7 is improved is considered as follows. Namely, since the concentration of the binder phase 3 in the phase aggregated portions 4 is increased by controlling the area proportion of the binder-phase-aggregated portions 4 on the surface of the cemented carbide 1 within a range from 10 to 70 area %, the binder phase 3 is diffused in the hard coating 7 and, as a result, the adhesion force of the hard coating 7 is improved.

Namely, when the binder-phase-aggregated portions 4 do not exist on the surface of the cemented carbide 1 and the cemented carbide has a uniform structure, the hard coating is insufficient in adhesion force and fracture resistance deteriorates. To the contrary, when the content of the binder phase on the entire surface of the cemented carbide 1 comprising the binder-phase-riched layer is uniformly large, the adhesion force of the hard coating also decreases. Also, when the area proportion of the binder-phase-aggregated portions 4 is less than 10 area % relative to the total area of the cemented carbide 1, the adhesion force of the hard coating decreases, chipping and fractures are caused by peeling of the hard coating. When the area proportion exceeds 70 area %, the content of metal increases and hardness on the surface of the cemented carbide 1 decreases, and thus plastic deformation resistance deteriorates.

The binder-phase-aggregated portions 4 coated with the hard coating 7 may be basically observed in the state of being coated with the hard coating 7. When it is difficult to observe binder-phase-aggregated portions 4 in the state of being coated with the hard coating 7 because of a large thickness of the hard coating 7, for example, the portion coated with no hard coating 7, like a wall surface of a threaded hole formed in the center of a throwaway tip, in which the surface of the cemented carbide 1 is exposed may be observed instead of the binder-phase-aggregated portions. Also, when there is not the portion in which the surface of the cemented carbide 1, it is also possible to observe a distribution state of the binder-phase-aggregated portions 4 in the state where the thickness of the hard coating 7 is decreased to some extent by polishing.

The material of the hard coating 7 includes, for example, carbide, nitride, oxide, boride, carbonitride, carbooxide, acid nitride and carbonitride of one or more kinds of metals selected from metals of groups 4, 5 and 6 of the Periodic Table, Si and Al, composite compound composed of two or more kinds of these compounds, and at least one selected from the group consisting of diamond-like carbon (DLC), diamond, $Al_2O_3$ and cubic boron nitride (cBN). These materials are preferable because they are excellent in mechanical properties and can improve wear resistance and fracture resistance.

Particularly the material of the hard coating 7 is represented by the formula: $(Ti_x,Al_{1-x})C_{1-y}N_y$ (where x and y satisfy the following relations: $0.2 \leqq x \leqq 0.7$ and $0 \leqq y \leqq 1$). Consequently, it is possible to obtain good compatibility with the binder-phase-aggregated portions 4, excellent wear resistance and excellent oxidation resistance, and high fracture resistance.

The thickness of the hard coating 7 is preferably 1 to 10 μm. Consequently, fracture resistance of the hard coating 7 is improved and also heat release properties on the surface of the hard coating 7 are improved.

Next, the method for producing the cemented carbide 1 described above will now be described. First, 79 to 94.8 mass % of a tungsten carbide (WC) powder having a mean particle size of 1.0 μm or less, 0.1 to 3 mass % of a vanadium carbide (VC) powder having a mean particle size of 0.3 to 1.0 μm, 0.1 to 3 mass % of a chromium carbide ($Cr_3C_2$) powder having a mean particle size of 0.3 to 2.0 μm, 5 to 15 mass % of a metallic cobalt (Co) having a mean particle size of 0.2 to 0.6 μm and, if necessary, a metallic tungsten (W) powder or carbon black (C) are mixed.

Next, in case of mixing, an organic solvent such as methanol is added so that the solid content of a slurry becomes 60 to 80 mass %, and then a proper dispersing agent is added. After the mixed powder was homogenized by grinding in a grinding equipment such as ball mill or vibrating mill for 10 to 20 hours as a grinding time, and then an organic binder such as paraffin is added to the mixed powder to obtain a mixed powder for forming.

The mixed powder is formed into a green compact having a predetermined shape by a known forming method such as press forming, casting, extrusion forming or cold isostatic pressing method, and the green compact is sintered under a pressure of 0.01 to 0.6 MPa in an argon gas at a temperature of 1,350 to 1,450° C., and preferably 1,375 to 1,425° C., for 0.2 to 2 hours, and then cooled to a temperature of 800° C. or lower at a cooling rate of 55 to 65° C./minute to obtain a cemented carbide 1.

Among the sintering conditions, when the sintering temperature is lower than 1,350° C., the alloy cannot be densified to cause a decrease in hardness. To the contrary, when the sintering temperature exceeds 1,450° C., both hardness and strength decrease as a result of the growth of WC particles. When the sintering temperature deviates from the above range, or the gas atmosphere is less than 0.01 MPa or more than 0.6 MPa during sintering, the binder-phase-aggregated portions are not produced and heat release properties on the surface of the cemented carbide deteriorate. Also, when sintering is carried out in a $N_2$ gas atmosphere, the binder-phase-aggregated portions are not produced. Moreover, a binder-phase-riched layer, which includes a large content of the binder phase and has a depth (thickness) of the surface zone of more than 5 μm, tends to be formed. Furthermore, when the cooling rate is less than 55° C./minute, the binder-phase-aggregated portions are not produced and, when the cooling rate is more than 65° C./minute, the area proportion of the binder-phase-aggregated portions increases excessively.

In order to coat the hard coating 7 on the surface of the cemented carbide 1 thus obtained, the hard coating 7 may be formed on the surface of the cemented carbide 1 after washing the cemented carbide 1. As the coating forming method, a known coating forming method such as a chemical vapor deposition (CVD) method [thermal CVD, plasma CVD, organic CVD, catalyst CVD, etc.] or a physical vapor deposition (PVD) method [ion plating, sputtering, etc.] can be employed. In view of the depth of the reaction zone between the metal element of the binder-phase-aggregated portions 4 and the hard coating 7, as well as adhesion between the cemented carbide 1 and the hard coating 7, the thickness of the hard coating 7 is preferably 0.1 to 10 μm, and particularly 0.1 to 3 μm in view of heat release properties.

Second Embodiment

Similar to the above embodiment, the cemented carbide of the second embodiment comprises 5 to 10 mass % of Co and/or Ni, 0 to 10 mass % of at least one selected from a carbide (except for WC), a nitride and a carbonitride of at least one selected from the group consisting of metals of groups 4, 5 and 6 of the Periodic Table, and the balanced amount of tungsten carbide. Also, a hard phase is composed mainly of tungsten carbide particles, and containing β particles of at least one selected from the carbide, the nitride and the carbonitride, is bonded through a binder phase composed mainly of Co and/or Ni.

When the content of Co and/or Ni in the cemented carbide is less than 5 mass %, toughness of the cemented carbide deteriorates and fracture resistance becomes worse. Therefore, when the cemented carbide is used in a cutting tool described hereinafter, the strength is insufficient in case of machining a Ti alloy or a heat resistant alloy and thus cutting edge fractures may often occur. When the content exceeds 10 mass %, hardness is insufficient in case of cutting a Ti alloy or a heat resistant alloy and wear resistance on the surface of the cemented carbide deteriorates. In the present embodiment, the content of Co and/or Ni as a binder phase is preferably within a range from 5 to 8.5 mass %, more preferably from 5 to 7 mass %, and still more preferably from 5.5 to 6.5 mass %, based on the total amount of the cemented carbide. Consequently, it is possible to satisfactorily sinter without increasing the mean particle size of WC particles in the cemented carbide to the value of more than 1.0 μm.

Particularly, when the content of Co and/or Ni is within a range from 5 to 7 mass %, sinterability may drastically deteriorate. Therefore, according to a conventional method, the cemented carbide could not be densified by sintering even in case of sintering at high temperature or sintering under pressure such as Sinter-HIP. Also, when the sintering temperature increases, the growth of WC particles occurs and it was difficult to convert the structure of the cemented carbide into fine particles. However, even when the content of Co and/or Ni is within a range from 5 to 7 mass %, the cemented carbide can be densified at the sintering temperature of 1,430° C. or lower, at which WC particles in the hard phase scarcely grow, by employing a production process described hereinafter.

When the content of the hard phase other than WC in the cemented carbide is within 10 mass %, the resulting tool has high mechanical impact resistance and thermal impact resistance and shows long tool life. Specific form of the hard phase is the same as that described above.

The cemented carbide of the present embodiment comprises a binder-phase-riched layer having a thickness of 0.1 to 5 μm on the surface, and also satisfies the following relationship: $0.02 \leqq I_{Co}/(I_{WC}+I_{Co}) \leqq 0.5$ where $I_{WC}$ denotes a (001) plane peak intensity of WC, and $I_{Co}$ denotes a (111) plane peak intensity of Co and/or Ni in an X-ray diffraction pattern of the surface. As described above, by controlling a state of the binder phase existing on the surface of the cemented carbide, namely, the thickness of the binder-phase-riched layer and an appearance state of the (111) plane peak of Co and/or Ni in a specific relation, the resulting cemented carbide is excellent in flexural strength. When the cemented carbide is used in a cutting tool described hereinafter, it is possible to suppress proceeding of wear and occurrence of chipping and to prolong tool life even under conventional cutting conditions where a special equipment for spraying a coolant under high pressure is not used in case of machining a heat resistant alloy such as Ti alloy.

On the other hand, when the binder-phase-riched layer is not formed or the thickness is less than 0.1 μm, since the content of Co and/or Ni serving as a lubricant layer is insufficient, cutting resistance increases and tooth point temperature increased, and thus oxidation of the cemented carbide in the vicinity of the tooth point rapidly proceeds. As a result, tooth point strength is lost and welding occurs, resulting in short tool life. When the thickness of the binder-phase-riched layer is more than 5 μm, the binder phase of the binder-phase-riched layer serving as a lubricant layer is deteriorated due to oxidation caused by heat generated during cutting and, because of a thick binder-phase-riched layer, a large amount of the deteriorated binder phase cause welding of a work material on the surface of the cutting tool, and thus desired dimensional accuracy cannot be obtained. The thickness of the binder-phase-riched layer is preferably within a range from 0.5 to 3 μm.

The binder-phase-riched layer means a surface zone which has a higher concentration of the binder phase as compared with the inside of the cemented carbide and also exists on the surface of the cemented carbide, and can be calculated by measuring concentration distribution in a depth direction of Co and/or Ni in the zone including the vicinity of the surface of a cross section of the cemented carbide using X-ray photoelectron spectroscopy (XPS), and measuring the thickness of the zone which has a higher concentration of Co and/or Ni as compared with the inside of the cemented carbide. Alternatively, the thickness of the binder-phase-riched layer can also be calculated by measuring the concentration of Co and/or Ni in a depth direction on the surface of the cemented carbide through Auger analysis.

On the other hand, when $I_{Co}/(I_{WC}+I_{Co})$ in the above X-ray diffraction pattern is less than 0.02, the binder-phase-riched layer becomes thin. To the contrary, when $I_{Co}/(I_{WC}+I_{Co})$ is more than 0.5, the binder-phase-riched layer becomes thick and wear resistance deteriorates. $I_{Co}/(I_{WC}+I_{Co})$ is preferably within the following range: $0.05 \leqq I_{Co}/(I_{WC}+I_{Co}) \leqq 0.2$.

In the present embodiment, when a value determined by the following equation (I) with respect to a peak of the tungsten carbide in the X-ray diffraction pattern is an orientation coefficient $T_c$ of (001) plane, a ratio of an orientation coefficient $T_{cs}$ in the surface to an orientation coefficient $T_{ci}$ in the cemented carbide, $(T_{cs}/T_{ci})$, is preferably 1 to 5. Consequently, it is possible to produce a state where WC is oriented on the face with high thermal conductivity on the surface of the cemented carbide and thermal conductivity on the surface of the cemented carbide is enhanced, and thus heat generated at the cutting edge is efficiently released and an increase in temperature of the cutting edge can be suppressed.

The inside of the cemented carbide means a depth zone extending from the surface of the cemented carbide to the depth of 300 μm or more.

[Equation 1]

$$T_C(001)=[I(001)/Io(001)]/[(1/n)\Sigma(I(hkl)/Io(hkl))] \quad \text{(I)}$$

where

I(hkl): a peak intensity of the (hkl) reflective plane of a X-ray diffraction measurement peak, Io(hkl): a standard peak intensity of X-ray diffraction data in an ASTM standard power pattern, $\Sigma I(hkl)=I(001)+I(100)+I(101)+I(110)+I(002)+I(111)+I(200)+I(102)$, n=8 (number of reflective plane peaks used to calculate Io(hkl) and I(hkl), and I(001) is $I_{WC}$ described above.

In the present embodiment, the content of oxygen in the cemented carbide is preferably 0.045 mass % or less relative to the mass of the entire cemented carbide, and also the mean particle size of WC particles as the hard phase is preferably 0.4 to 1.0 μm. Consequently, proceeding of oxidation at high temperature can be prevented because of less oxygen content of the cemented carbide. Also, since the mean particle size of WC particles of the hard phase is within the above range, the cemented carbide has high hardness and a cutting tool using the cemented carbide is excellent in machinability.

Specifically, when the content of oxygen in the cemented carbide is 0.045 mass % or less based on the mass of the entire cemented carbide, it is possible to suppress proceeding of oxidation at the cutting edge, which is exposed to high temperature during cutting, of the cutting tool using the cemented carbide and to stably cut for a long period. Even if the content of Co and/or Ni is within a range from 5 to 7 mass %, by employing a method described hereinafter in which the particle size of a raw powder of WC and a grinding method are improved, the cemented carbide can be sintered at low temperature and also the content of oxygen in the cemented carbide can be controlled to 0.045 mass % or less relative to the entire cemented carbide.

In view of stability of machinability and chipping resistance, the mean particle size of WC particles constituting the hard phase is 1 μm or less, preferably 0.4 to 1.0 μm, and particularly preferably 0.6 to 1.0 μm.

Also, it is preferred to control arithmetic average roughness (Ra) on the surface of the cemented carbide to 0.2 μm or less in view of an improvement in wear resistance, reduction of cutting resistance, and an improvement in welding resistance and fracture resistance. The surface roughness of the surface of the cemented carbide may be measured while moving the cemented carbide (cutting tool) so that the measuring surface is vertical to laser, using a contact type surface roughness meter or a non-contact type laser microscope. In case the cutting edge itself has waviness, surface roughness may be calculated after subtraction of this waviness (filtered waviness curve defined in JIS B0610) and further linear approximation.

Although R horning or chamfer horning may be applied in the vicinity of the cutting edge of the sintered cemented carbide, it is also possible to form the cutting edge into a horning shape before sintering. According to this method, distribution of the concentration of Co and/or Ni on the surface of the cutting edge can be controlled more accurately.

Next, the method for producing the cemented carbide according to the embodiment described above will now be described. First, for example, 80 to 95 mass % of a WC powder having a mean particle size of 0.01 to 1.5 μm, 0 to 10 mass % of a powder having a mean particle size of 0.3 to 2.0 μm of at least one selected from a carbide (except for WC), a nitride and a carbonitride of at least one selected from the group consisting of metals of groups 4, 5 and 6 of the Periodic Table, 5 to 10 mass % of a Co powder having a mean particle size of 0.2 to 3 μm and, if necessary, a metallic tungsten (W) powder or carbon black (C) are added. To these powders, a solvent is added, followed by mixing and optional addition of an organic binder to obtain granules for forming.

The above granules are formed into a green compact having a predetermined shape by a known forming method such as press forming, casting, extrusion forming or cold isostatic pressing, heated in an atmosphere evacuated to vacuum degree of 0.4 kPa or less and then sintered at a temperature of 1,320 to 1,430° C. for 0.2 to 2 hours. In the present embodiment, the atmosphere upon sintering is set to an autogeneous atmosphere containing only a cracked gas released from a sintering body itself by evacuating until the temperature reaches the above sintering temperature, terminating the evacuation after the temperature reaches the sintering temperature, and closing a sintering furnace so as to achieve a pressure state described hereinafter. In the autogeneous atmosphere, a sensor is provided and an argon gas is introduced so as to adjust the pressure in the sintering furnace to a constant pressure of 0.1 to 10 kPa, or a portion of a gas in the furnace is deaerated to adjust the pressure in the sintering furnace. When sintering was completed, the sintered compact is cooled to the temperature of 1,000° C. or lower at a cooling rate of 50 to 400° C./minute to obtain a cemented carbide of the present embodiment.

By controlling to the above production conditions, the thickness of the binder-phase-riched layer and the value $I_{Co}/(I_{WC}+I_{Co})$ in an X-ray diffraction pattern can be controlled within the above predetermined range. For example, when the heating atmosphere during sintering is an inert gas atmosphere, the thickness of the binder-phase-riched layer exceeds 5 μm. When the sintering atmosphere is a vacuum atmosphere, the thickness of the binder-phase-riched layer becomes smaller than 0.1 μm. When the sintering atmosphere is an inert gas atmosphere, the thickness of the binder-phase-riched layer tends to become larger than 5 μm. Among the above production conditions, when the amount of Co and/or Ni powder to be added is controlled within a range from 5.5 to 8.5 mass %, the ratio of orientation coefficient $T_{cs}/T_{ci}$ can be controlled within a range from 1 to 5.

Also, binder-phase-aggregated portions of the first embodiment can be formed by this method.

In the above production process, when the following production process is employed, even if the content of Co and/or Ni is 5 to 7 mass %, it becomes possible to decrease the sintering temperature of the cemented carbide and a raw powder such as WC powder does not grow during sintering, and thus the particle size of the hard phase can be controlled to 1 μm or less and also the content of oxygen in the cemented carbide can be controlled to 0.045 mass % or less relative to the entire cemented carbide. Namely, in order to control the content of oxygen in the cemented carbide and the mean particle size of WC particles within the above range, a coarse powder is used as a WC raw powder and the particle size of the mixed powder is controlled to a desired particle size upon powder mixing and, furthermore, a production method of improving sinterability of a WC powder in case of sintering a cemented carbide in which oxidation of the surface of the WC powder included in the green compact is suppressed is employed. Thus, the content of oxygen in the cemented carbide can be controlled to 0.045 mass % or less. Consequently, it becomes easy to sinter the cemented carbide and the occurrence of defects as a causative of fracture can be suppressed without causing the growth of WC particles.

Even when the content of Co and/or Ni as the binder phase in the cemented carbide is small as 5 to 7 mass %, sintering can be carried out under a normal pressure atmosphere at a low temperature of 1,430° C. or lower and the resulting cemented carbide is excellent in hardness, strength and toughness. As a result, it is possible to obtain a cutting tool made of a cemented carbide, which has high reliability.

Specifically, a WC powder having a controlled mean particle size of 5 to 200 μm is used as a raw material and is added in a solvent including less oxygen content, followed by mixing and further grinding, thereby adjusting the mean particle size of the raw powder in the slurry to 1.0 μm or less. By grinding the WC powder, a non-oxidized active powder surface is exposed. In case of forming and sintering the WC powder, it is possible to densify at low temperature even in case of less metal content because of high sinterability between particles, and also a cemented carbide composed of fine particles having excellent sinterability can be produced even if the content of Co and/or Ni is from 5 to 7 mass %.

In case of using this production method, since the content of unavoidable oxygen in the green compact decreases, it is possible to suppress a carbon monoxide (CO) gas from generating during sintering. As a result, decarbonization of the green compact generated during sintering can be reduced. Therefore, it becomes possible to accurately control the content of carbon in the sintered body, which is important in the cemented carbide. As a result, fractures in the sintered body caused during the sintering process can be suppressed and also it becomes easy to control the content of carbon in the cemented carbide.

Describing the production process in more detail, to a mixed powder of 80 to 95 mass %, particularly 93 to 95 mass % of a WC powder having a mean particle size of 5 to 200 μm, 0 to 10 mass %, particularly 0.3 to 2 mass % of a powder having a mean particle size of 0.3 to 2.0 μm of at least one selected from a carbide (except for WC), a nitride and a carbonitride of at least one selected from the group consisting of metals of groups 4, 5 and 6 of the Periodic Table, 5 to 10 mass %, particularly 5 to 7 mass % of a Co and/or Ni powder having a mean particle size of 0.2 to 3 μm and, if necessary, a metallic tungsten (W) powder or carbon black (C), water including an oxygen content of 100 ppm or less or an organic solvent including an oxygen content of 100 ppm or less, as a solvent, is added to obtain a slurry, and then the slurry is wet-ground. At this time, the slurry is ground using a grinding device having a strong crushing force such as atriter mill, jet mill or planetary mill until the mean particle size of the ground mixed powder becomes 1.0 μm or less.

Then, the ground slurry is charged in a spray dryer to obtain granules for forming. In the process of grinding the mixed powder and the process of producing granules for forming, it is preferred to prevent oxygen from introducing into granules for forming as possible in a nonoxidative atmosphere by introducing an inert gas.

The granules for forming are formed into green compact having a predetermined shape by a forming method such as press forming or cold isostatic pressing, heated in an atmosphere evaluated to vacuum degree of 0.4 kPa or less, and then sintered in the above autogeneous atmosphere at a temperature of 1,320 to 1,430° C. for 0.2 to 2 hours. When the sintering was completed, furnace cooling is carried out. In the cooling step, the content of oxygen in the cemented carbide can be controlled to 0.045 mass % or less relative to the entire cemented carbide by cooling while introducing an inert gas.

The constitutions other than those described above are the same as those in the first embodiment and therefore further explanation is omitted here.

Third Embodiment

The cemented carbide of the third embodiment comprises 5 to 7 mass % of Co and/or Ni, 0 to 10 mass % of at least one selected from a carbide (except for WC), a nitride and a carbonitride of at least one selected from the group consisting of metals of groups 4, 5 and 6 of the Periodic Table, and the balanced amount of tungsten carbide. Similar to the above embodiments, a hard phase is composed mainly of tungsten carbide particles, and containing β particles of at least one selected from the carbide, the nitride and the carbonitride, is bonded through a binder phase composed mainly of Co and/or Ni.

In the present embodiment, the content of the binder phase in the cemented carbide is 5 to 7 mass %, the mean particle size of the hard phase is 0.6 μm to 1.0 μm, saturation magnetization is 9 to 12 $\mu Tm^3/kg$, the coercive force Hc is 15 to 25 kA/m, and the oxygen content is 0.045 mass % or less. Consequently, the resulting cemented carbide has high hardness and high toughness. When the cemented carbide is used in a cutting tool, the resulting tool is excellent in wear resistance and fracture resistance. Because of low content of the binder phase, a work material made of a Ti alloy or a heat resistant alloy is less likely to be welded and thus it is possible to prevent chipping of the cutting edge due to welding and a become rough in surface roughness of the worked surface.

On the other hand, when the content of the binder phase is less than 5 mass %, fracture resistance of the cutting tool deteriorates because of insufficient toughness of the cemented carbide. Since sinterability drastically deteriorate and a special sintering method is required to sinter the compact, cost increases too much. When the content of the binder phase exceeds 7 mass %, hardness of the cemented carbide decreases and wear resistance of the cutting tool deteriorates. When the content of the binder phase is large, a work material is welded to the cutting edge of the tool, and thus there arises a problem that the worked surface is roughened by the work material welded to the cutting edge or flank face and chipping occurs in case of coming off the welded work material.

When the mean particle size of the hard phase is less than 0.6 μm, hardness of the cemented carbide increases excessively and fracture resistance of the cutting tool deteriorates. Also, sinterability of the cemented carbide deteriorates and sintering failure is likely to occur, resulting in drastic decrease of strength and hardness. When the mean particle size of the hard phase is more than 1.0 μm, sufficient hardness of the cemented carbide cannot be obtained and wear resistance of the cutting tool deteriorates. The mean particle size of the hard phase is preferably within a range from 0.75 to 0.95 μm.

When saturation magnetization is less than 9 $\mu Tm^3/kg$, hardness increases excessively because of low content of carbon in the cemented carbide, and thus toughness of the cemented carbide deteriorates and fracture resistance of the cutting tool deteriorates. When saturation magnetization exceeds 12 $\mu Tm^3/kg$, hardiness of the cemented carbide decreases because of excess content of carbon in the cemented carbide, and thus sufficient wear resistance of the cutting tool cannot be obtained and damages such as abnormal wear and fractures of the cutting edge due to proceeding of wear may occur. The saturation magnetization is preferably within a range from 9.5 to 11 $\mu Tm^3/kg$.

When the coercive force Hc of the cemented carbide is less than 15 kA/m, the thickness (so-called mean free path) of the binder phase, which bonds the space between hard phases in the cemented carbide, increases excessively and deterioration of wear resistance due to a decrease in hardness of the cemented carbide and welding of the work material occurs, and thus there arise a problem such as chipping of the cutting edge due to welding and roughening of worked surface of the work material. When the coercive force exceeds 25 kA/m, the thickness (mean free path) of the binder phase in the cemented carbide decreases excessively, and thus toughness of the cemented carbide becomes insufficient and fracture resistance deteriorates, resulting in damages such as chipping of the cutting edge and sudden fractures. The coercive force is preferably within a range from 18 to 22 kA/m.

When the content of oxygen in the cemented carbide exceeds 0.045 mass % in terms of the proportion relative to the amount of the entire cemented carbide, a coercive force, which bonds the hard phase of the binder phase, decreases at high temperature. Therefore, when the temperature of the cutting edge becomes higher during cutting, the strength of the cemented carbide decreases and thus chipping and fractures occur. The content of oxygen in the cemented carbide is preferably 0.035 mass % or less.

Similar to the embodiments described above, cemented carbide may contain, in addition to WC and Co, at least one kind of a carbide (except for WC), a nitride or a carbonitride selected from the group consisting of metals of groups 4, 5 and 6 of the Periodic Table in the proportion of 0 to 10 mass %.

It is particularly preferred to include Cr in the proportion of 2 to 10 mass %, and preferably 3 to 7 mass %, in terms of carbide ($Cr_3C_2$) relative to the content (mass %) of the binder phase in the cemented carbide. Consequently, corrosion resistance of the cemented carbide can be improved by preventing the strength of the binder phase from decreasing without causing deterioration such as oxidation or corrosion of the binder phase. A cutting tool using the cemented carbide can suppress deterioration such as oxidation or corrosion of the tool surface and to prevent a decrease in strength due to deterioration. When the temperature of the cutting edge becomes higher during cutting, Cr, which was dissolved in the binder phase to form a solid solution, forms an oxide layer to suppress proceeding of oxidation of the binder phase, and thus thermal deterioration of the binder phase can be suppressed. Furthermore, the oxide layer is chemically stable and therefore scarcely reacts with a work material, and thus the work material is less likely to deposit on the cutting edge and excellent machinability can be exhibited during cutting of a Ti alloy which is likely to be welded. Also, Cr has the effect capable of controlling the particle size of the hard phase in the cemented carbides by suppressing the grain growth of the hard phase in case of sintering the cemented carbide.

In addition to Cr, vanadium (V) and tantalum (Ta) can be preferably used so as to suppress the grain growth of the hard phase during sintering. At least portion of Cr, V and Ta may be dissolved in the binder phase to form a solid solution, while the remainder may exist as a carbide alone, or a composite carbide using two or more kinds of them in combination with tungsten (W).

On the surface of the cemented carbide of the present invention, a hard coating layer composed of any of a compound of one or more elements elected from the group consisting of metals of groups 4, 5 and 6 of the Periodic Table, aluminum (Al) and silicone (Si) and one or more elements elected from carbon, nitrogen, oxygen and boron, hard carbon, and cubic boron nitride may be formed. Consequently, high adhesion between a cemented carbide substrate and a hard coating layer can be obtained without causing deterioration of the surface of the cemented carbide substrate upon coating formation as a result of an influence of oxygen. As a result, wear resistance of the cutting tool can be more improved without causing peeling of the hard coating layer and chipping.

Examples of the material suited for used as the hard coating layer include titanium carbide (TiC), titanium nitride (TiN) and titanium carbonitride (TiCN), titanium-aluminum composite nitride (TiAlN) and aluminum oxide ($Al_2O_3$). These materials have both high hardness and high strength and are excellent in wear resistance and fracture resistance. The hard coating layer having a thickness of 0.1 to 1.8 μm formed by a physical vapor deposition (PVD) method is preferable because peeling of the hard coating layer can be suppressed while maintaining high wear resistance in case of cutting a heat resistant alloy, which has high strength and is likely to be adhered, and thus excellent tool life can be exhibited in case of cutting a heat resistant alloy.

Next, the method for producing the cemented carbide according to the embodiment described above will now be described. First, 83 to 95 mass % of a tungsten carbide (WC) powder having a mean particle size of 5 to 200 μm, 0 to 10 mass % of at least one selected from a carbide (except for tungsten carbide (WC)), a nitride and a carbonitride of at least one selected from the group consisting of metals of groups 4, 5 and 6 of the Periodic Table having a mean particle size of 0.3 to 2.0 μm, 5 to 7 mass % of a metallic cobalt (Co) powder having a mean particle size of 0.2 to 3 μm and, if necessary, a metallic tungsten (W) powder or carbon black (C) are blended and water or a solvent and, if necessary, an organic solvent are added, followed by mixing. Then, the mixed powder is ground by controlling the grinding time using a known grinding device such as ball mill or vibrating mill so that D50 value (particle size of Microtrac Analysis at an appearance rate of 50%) of average particles of the ground mixed raw material in the measurement of particle size distribution using Microtrac becomes within a range from 0.4 to 1.0 μm.

Namely, a lot of fresh surfaces, on which oxygen is not adsorbed, of WC particles are exposed by finely grinding using a coarse WC powder having a mean particle size of 5 to 200 μm so as to adjust the mean particle size, which is ⅕ times smaller than the original mean particle size and is also 1.0 μm or less. Therefore, the content of oxygen in the mixed powder and green compact decreases and surface energy of the respective particles in the mixed powder, and thus it becomes easy to sinter the compact. Moreover, since wetting of the WC powder with binder phase is improved, sintering can be carried out at low temperature at which fractures such as pores and cracking do not occur even in case of low content of the binder phase.

The mixed powder is formed into a green compact having a predetermined shape by a known forming method such as press forming, casting, extrusion forming or cold isostatic pressing, and then sintered in an autogeneous atmosphere in the present invention.

As used herein, the autogeneous atmosphere means an atmosphere containing only a cracked gas released from a sintering body itself when evacuation is carried out until the temperature reaches the above sintering temperature and evacuation is terminated after the temperature reaches the sintering temperature, and then a sintering furnace is closed so as to achieve a pressure state described hereinafter. In the autogeneous atmosphere, a sensor is provided and an argon gas is introduced so as to adjust the pressure in the sintering furnace to a constant pressure of 0.1 to 10 kPa, or a portion of a gas in the furnace is deaerated to adjust the pressure in the sintering furnace.

When sintering was completed, the sintered compact is cooled to the temperature of 1,000° C. or lower at a cooling rate of 50 to 400° C./minute to obtain a cemented carbide of the present embodiment.

Also, the binder-phase-aggregated portions of the first embodiment can be formed by this method.

The edge portion serving as the cutting edge of the resulting cemented carbide can also be used in the form of a sharp edge without being machined, but R horning for forming a small margin of 10 μm or less when seeing from the side of rake face, or chamfer horning may be optionally applied to the edge portion serving as the cutting edge, and the surface of the cutting edge may be subjected to a polishing treatment such as brushing or blasting treatment.

Then, the hard coating of the type described above is formed. The hard coating layer can be formed by a known coating forming method such as a chemical vapor deposition method (thermal CVD, plasma CVD, organic CVD, catalyst CVD, etc.) or a physical vapor deposition method (ion plating, sputtering, etc.). It is particularly preferred to form a coating by a physical vapor deposition method such as an arc ion plating method or a sputtering method because the resulting coating is excellent in wear resistance and lubricity, whereby, excellent machinability is exhibited against cutting of a heat resistant alloy as a hard-to-cut material.

The constitutions other than those described above are the same as those in the first and second embodiments and therefore further explanation is omitted here.

<Cutting Tool>

A cutting tool of the present invention will now be described. The cemented carbides of the respective embodiments described above have high hardness, high strength and excellent deformation resistance and also have high reliability mechanical properties, and therefore they can be applied to dies, wear resistant members and high temperature structural materials, and can be particularly preferably used as a cutting tool comprising a cutting edge, which is formed along a ridge where a flank face and a rake face thereof meet, composed of the cemented carbide of each embodiment, the formed along a ridge where a flank face and a rake face thereof meet being used by pressing the cutting edge against a work material. Specifically, when the cemented carbides of the first to third embodiments are used as the cutting tool, since the temperature of the cutting edge of the cutting tool does not become higher excessively during machining, a problem such as cloudiness of the worked surface of a work material to be machined and a smooth and glossy finished surface is formed.

Particularly, when the cutting edge is composed of the cemented carbide 1 of the first embodiment, the resulting cutting tool made of the cemented carbide is excellent in wear resistance and welding resistance. Particularly, when this cutting tool is used for cutting a stainless steel or a Ti alloy, which is likely to be welded, it exerts higher effect on welding resistance and shows excellent tool life. Also, when the cutting tool coated with a hard coating layer is used for cutting a stainless steel, peeling of the hard coating may occur because cutting resistance is high and the temperature of the cutting edge tends to become higher. However, since the hard coating 7 of the first embodiment has high adhesion force, excellent machinability are exhibited even in case of being coated with the hard coating layer.

When the cutting edge is composed of the cemented carbide of the second embodiment, it is possible to suppress proceeding of wear and occurrence of chipping and to prolong tool life even under conventional cutting conditions where a special equipment for spraying a coolant under high pressure is used in case of machining a heat resistant alloy such as Ti alloy.

When the cutting edge is composed of the cemented carbide of the third embodiment, because of having a high wear resistance without decreasing the strength and also having excellent welding resistance due to low content of the binder phase, even in case of a cutting tool composed of a cemented carbide coated with no hard coating layer, very excellent performances can be exhibited in cutting of a Ti alloy which is likely to be welded and is inferior in thermal conductivity, and is hard to cut because of high strength at high temperature. Also, when a hard coating layer is formed, since wear resistance and strength are improved, very excellent performances can be exhibited in cutting of a heat resistant alloy having higher strength. Specifically, the resulting cutting tool shows excellent wear resistance and longer tool life. The heat resistant alloy is a generic name of a nickel (Ni)-based alloy such as Inconel, Hastelloy or Stellite, a cobalt (Co)-based alloy, and an iron (Fe)-based alloy such as Incoloy.

Even if the cemented carbides of the respective embodiments are used in applications other than the cutting tool, excellent mechanical reliability is achieved.

The present invention will now be described in detail by way of Examples, but the present invention is not limited to the following Examples.

Example I

<Production of Cemented Carbide>

A tungsten carbide (WC) powder, a metallic cobalt (Co) powder, a vanadium carbide (VC) powder and a chromium carbide ($Cr_3C_2$) powder were added in proportions shown in Table 1, ground and mixed in a vibrating mill for 18 hours and, after drying, the mixed powder was press formed into a tip for throwaway end mill (cutting tool). The resulting green compact was heated from a temperature, which is at least 500° C. lower than a sintering temperature, at a heating rate of 10° C./minute and then sintered under the sintering conditions shown in Table 1 to obtain cemented carbides (Sample Nos. I-1 to I-14 in Table 1). A cooling rate in Table 1 shows a cooling rate until the cemented carbides are cooled to 800° C. or lower after sintering. Also, "Ar" in Table 1 means an argon gas, while "$N_2$" means a nitrogen gas.

TABLE 1

| Sample No. | Composition(mass %) WC | VC | $Cr_3C_2$ | Co | Sintering conditions: Types of gas | Gas pressure (MPa) | Sintering temperature (° C.) | Cooling rate (° C./minute) |
|---|---|---|---|---|---|---|---|---|
| I-1 | 91.3 | 0.2 | 0.5 | 8 | Ar | 0.08 | 1350 | 55 |
| I-2 | 83.0 | 0.3 | 1.7 | 15 | Ar | 0.05 | 1375 | 58 |
| I-3 | 93.8 | 0.1 | 0.1 | 6 | Ar | 0.06 | 1375 | 59 |
| I-4 | 87.8 | 0.4 | 0.8 | 11 | Ar | 0.15 | 1400 | 56 |
| I-5 | 89.2 | 0.2 | 0.6 | 10 | Ar | 0.10 | 1400 | 55 |
| I-6 | 87.3 | 0.2 | 0.5 | 12 | Ar | 0.50 | 1425 | 58 |
| I-7 | 91.2 | 0.1 | 0.7 | 8 | Ar | 0.01 | 1425 | 62 |
| I-8 | 87.8 | 0.2 | 3.0 | 9 | Ar | 0.30 | 1450 | 60 |
| *I-9 | 85.4 | 5.0 | 0.6 | 9 | Ar | 0.70 | 1350 | 55 |
| *I-10 | 88.9 | 0.1 | 1.0 | 10 | — | | 1375 | 57 |
| *I-11 | 88.3 | 0.5 | 1.2 | 10 | Ar | 0.20 | 1400 | 50 |
| *I-12 | 84.9 | 0.8 | 1.3 | 13 | Ar | 0.60 | 1300 | 68 |
| *I-13 | 91.0 | 1.0 | 1.0 | 7 | $N_2$ | 0.80 | 1325 | 57 |
| *I-14 | 90.6 | 0.7 | 0.7 | 8 | Ar | 0.60 | 1600 | 58 |

Samples marked '*' are out of the scope of the present invention.

With respect to each arbitrary surface of the resulting cemented carbides, a secondary electron image (200 times) as shown in FIG. 2 was observed by a scanning electron microscope. With respect to an arbitrary zone measuring 6 mm×5 mm, the area and the average diameter of the binder-phase-aggregated portions were measured, and then an existing ratio (an area proportion of binder-phase-aggregated portions in the vision zone where the binder-phase-aggregated portions were measured). The number of the binder-phase-aggregated portions measured was 10 or more and the average value was calculated. The mean particle size of WC particles was calculated by a LUZEX image analysis method. The results are shown in Table 2.

With respect to the arbitrary surface of the resulting cemented carbide, the content of metallic Co on the arbitrary surface was measured by energy dispersive X-ray microanalyzer (Energy Dispersive System: EDS) analysis. The results are shown in Table 2.

Furthermore, a cemented carbide having a tip shape was mounted onto a throwaway end mill and a cutting evaluation test was carried out under the following conditions, using a machine center, and then machinability was evaluated. The results are shown in Table 2.

<Cutting Conditions>

(Wear Resistance Evaluation Test (Shoulder Machining))

Work Material: Stainless Steel (SUS) 304

Cutting Speed: V=150 (m/minute)

Feed Rate: 0.12 m/minute

Infeed: d (depth of slot)=3 mm, w (width of slot)=10 mm

Others: Dry Cutting

Evaluation Method: A wear width of a cutting edge was measured in case of cutting for 20 minutes.

(Fracture Resistance Evaluation Test (Shoulder Machining))

Work Material: SUS304

Cutting Speed: V=150 (m/minute)

Feed Rate: 0.1 m/minute

Infeed: d (depth of slot)=4 mm, w (width of slot)=5 mm

Others: Dry Cutting

Evaluation Method: The cutting time of each sample, in which it becomes impossible to cut a work material due to the occurrence of fractures of a cutting edge, was measured.

TABLE 2

| Sample No. | Mean particle size of WC (μm) | Binder-phase-aggregated portions: Existing ratio (area %) | Mean particle size (μm) | Aggregated portion/Normal portion[1)] | Total content of binder phase on surface (mass %) | Machinability: Wear width (mm) | Cutting time (minute) |
|---|---|---|---|---|---|---|---|
| I-1 | 1.0 | 70 | 210 | 7.0 | 70 | 0.20 | 15 |
| I-2 | 0.8 | 65 | 180 | 3.8 | 62 | 0.18 | 17 |
| I-3 | 0.9 | 52 | 160 | 6.5 | 57 | 0.11 | 13 |
| I-4 | 0.6 | 49 | 120 | 3.8 | 41 | 0.12 | 22 |
| I-5 | 1.0 | 53 | 100 | 4.4 | 30 | 0.08 | 25 |
| I-6 | 0.9 | 56 | 140 | 4.0 | 23 | 0.09 | 20 |
| I-7 | 0.7 | 19 | 80 | 1.9 | 19 | 0.05 | 15 |
| I-8 | 0.8 | 15 | 70 | 1.4 | 15 | 0.08 | 10 |
| *I-9 | 1.0 | — | — | — | 99 | 0.42 | 2 |
| *I-10 | 0.9 | — | — | — | 5 | 0.40 | 3 |
| *I-11 | 0.7 | — | — | — | 2 | 0.37 | 2 |
| *I-12 | 0.9 | — | — | — | 83 | 0.32 | 1 |
| *I-13 | 0.8 | — | — | — | 90 | 0.35 | 4 |
| *I-14 | 1.0 | — | — | — | 1 | 0.44 | 3 |

Samples marked '*' are out of the scope of the present invention.

[1)]Aggregated portion/Normal portion:

Total content of binder phase (Co + Ni) in aggregated portion/Total content of binder phase (Co + Ni) in normal portion on the surface of cemented carbide.

As is apparent from the results shown in Tables 1 and 2, in all samples Nos. I-9 to I-14, the proportion of the area of binder-phase-aggregated portions on the surface of the cemented carbide was less than 10% and the work material was welded to the cutting edge, and also the cutting time in the fracture resistance evaluation test was short and the wear width in the wear resistance evaluation test was large.

On the other hand, in samples Nos. I-1 to I-8 in which mixing, grinding and sintering conditions of a raw mixed powder are controlled within each predetermined range in accordance with the present invention and the proportion of the area of the island-shaped portion in the binder-phase-aggregated portions is 10 to 70%, heat release properties are improved, and thus the temperature of the cutting edge is less likely to become higher and welding resistance is excellent. Also, the total content of the binder phase is 15 to 70 mass % relative to the entire surface on the surface of the cemented carbide substrate, and the samples exhibited excellent fracture resistance and wear resistance, for example, the cutting time of 5 minutes or more and the wear width of 0.20 mm or more in the cutting test.

Example II

Using the cemented carbide of Example I, the surface of the cemented carbide was washed and then the hard coating having the thickness shown in Table 3 was formed by an ion plating method (samples No. II-1 to II-14 in Table 3).

TABLE 3

| Sample No. | Cemented carbide sample No. | Hard coating: Types of material | Hard coating: Thickness (μm) | Machinability: Wear width (mm) | Machinability: Cutting time (minute) |
|---|---|---|---|---|---|
| II-1 | I-1 | TiAlN + TiN | 0.7 | 0.08 | 12 |
| II-2 | I-2 | TiAlN | 0.3 | 0.12 | 18 |
| II-3 | I-3 | TiCN | 0.5 | 0.15 | 17 |
| II-4 | I-4 | TiN | 0.6 | 0.11 | 25 |
| II-5 | I-5 | TiAlN | 0.9 | 0.07 | 27 |
| II-6 | I-6 | TiAlN + TiN | 0.4 | 0.10 | 22 |
| II-7 | I-7 | TiCN | 0.8 | 0.09 | 20 |
| II-8 | I-8 | TiN | 0.2 | 0.10 | 15 |
| *II-9 | I-9 | TiAlN | 0.5 | 0.40 | 2 |
| *II-10 | I-10 | TiCN | 0.7 | 0.38 | 3 |
| *II-11 | I-11 | TiN | 1.2 | 0.35 | 1 |
| *II-12 | I-12 | TiAlN | 0.1 | 0.39 | 4 |
| *II-13 | I-13 | TiAlN + TiN | 3 | 0.36 | 2 |
| *II-14 | I-14 | TiCN | 1.4 | 0.37 | 1 |

Samples marked '*' are out of the scope of the present invention.

Furthermore, a cemented carbide having a tip shape was mounted onto a throwaway end mill and a cutting evaluation test was carried out under the following conditions, using a marching center, and then machinability was evaluated. The results are shown in Table 3.

<Cutting Conditions>

(Wear Resistance Evaluation Test (Shoulder Machining))

Work Material: SUS304

Cutting Speed: V=200 (m/minute)

Feed Rate: 0.12 m/minute

Infeed: d (depth of slot)=3 mm, w (width of slot)=10 mm

Others: Dry Cutting

Evaluation Method: A wear width of a cutting edge was measured in case of cutting for 20 minutes.

(Fracture Resistance Evaluation Test (Shoulder Machining))

Work Material: SUS304

Cutting Speed: V=200 (m/minute)

Feed Rate: 0.1 m/minute

Infeed: d (depth of slot)=4 mm, w (width of slot)=5 mm

Others: Dry Cutting

Evaluation Method: The cutting time of each sample, in which it becomes impossible to cut a work material due to the occurrence of fractures of a cutting edge, was measured.

As is apparent from the results shown in Table 3, in all samples Nos. II-9 to II-14, the proportion of the area of binder-phase-aggregated portions on the surface of the cemented carbide was less than 10% and the hard coating peeled off, and also the cutting time in the fracture resistance evaluation test was short and the wear width in the wear resistance evaluation test was large.

On the other hand, in samples Nos. II-1 to II-8 in which mixing, grinding and sintering conditions of a raw mixed powder are controlled within each predetermined range in accordance with the present invention, the proportion of the area of the binder-phase-aggregated portions is 10 to 70% and adhesion of the hard coating is high, and also heat release properties are improved, and thus the temperature of the cutting edge is less likely to become higher and welding resistance is excellent. Also, the samples exhibited excellent fracture resistance and wear resistance, for example, the cutting time of 12 minutes or more and the wear width of 0.15 mm or more in the cutting test.

Example III

<Production of Cemented Carbide>

A WC powder, a Co powder and the other carbide powder, each having the mean particle size shown in Table 4, were mixed in the proportion shown in Table 4 and a mixed powder was added in deoxygenated water including an oxygen content of 10 ppm to form a slurry, and then the slurry was ground and mixed in an atriter mill until the mean particle size becomes the mean particle size shown in Table 4. At this time, the mean particle size was measured by a laser diffraction scattering method (Microtrac) and a value at a frequency of 50% in particle size distribution (D50 value) was taken as a particle size of the mixed powder.

TABLE 4

| Sample No. | Composition of raw materials: WC Mean particle size (μm) | WC Amount | Co Mean particle size (μm) | Co Mass % | Other additives Types | Other additives Mean particle size (μm) | Other additives Mass % | D50 value after mixing powders (μm)[1)] |
|---|---|---|---|---|---|---|---|---|
| III-1 | 0.6 | balance | 1 | 5 | $Cr_3C_2$ | 1.5 | 1 | 0.52 |
| | | | | | VC | 1.0 | 0.5 | |
| III-2 | 0.8 | balance | 1 | 6 | $Cr_3C_2$ | 1.5 | 0.5 | 0.76 |
| | | | | | VC | 1.0 | 0.1 | |
| III-3 | 0.9 | balance | 1 | 7 | TiC | 1.2 | 0.2 | 0.81 |
| | | | | | VC | 2.0 | 0.1 | |

TABLE 4-continued

| | Composition of raw materials | | | | | | | |
|---|---|---|---|---|---|---|---|---|
| | WC | | Co | | Other additives | | | D50 value |
| Sample No. | Mean particle size (μm) | Amount | Mean particle size (μm) | Mass % | Types | Mean particle size (μm) | Mass % | after mixing powders (μm)[1)] |
| III-4 | 0.7 | balance | 1 | 8 | TiC | 1.2 | 2.5 | 0.56 |
| | | | | | $Cr_3C_2$ | 1.5 | 1.5 | |
| | | | | | ZrC | 1.5 | 1.0 | |
| III-5 | 1.1 | balance | 1 | 10 | $Cr_3C_2$ | 1.5 | 1 | 0.82 |
| | | | | | VC | 1.0 | 0.5 | |
| *III-6 | 0.6 | balance | 1 | 5 | $Cr_3C_2$ | 1.5 | 1 | 0.47 |
| | | | | | VC | 1.0 | 0.5 | |
| *III-7 | 0.8 | balance | 1 | 6 | TiC | 1.2 | 0.6 | 0.74 |
| | | | | | VC | 0.7 | 1 | |
| *III-8 | 0.9 | balance | 1 | 7 | TiC | 1.2 | 2.0 | 0.53 |
| | | | | | NbC | 2.0 | 5.5 | |
| | | | | | ZrC | 1.5 | 1.5 | |
| *III-9 | 1.0 | balance | 1 | 12 | $Cr_3C_2$ | 1.5 | 1 | 0.79 |
| | | | | | VC | 0.7 | 0.5 | |
| *III-10 | 10 | balance | 1 | 12 | $Cr_3C_2$ | 1.5 | 1 | 1.5 |
| | | | | | VC | 0.7 | 0.5 | |
| III-11 | 5 | balance | 1 | 5 | $Cr_3C_2$ | 1.5 | 1 | 0.56 |
| | | | | | VC | 1.0 | 0.5 | |
| III-12 | 10 | balance | 1 | 6 | $Cr_3C_2$ | 1.5 | 0.5 | 0.78 |
| | | | | | VC | 1.0 | 0.1 | |
| III-13 | 100 | balance | 1 | 7 | TiC | 1.2 | 0.2 | 0.84 |
| | | | | | VC | 2.0 | 0.1 | |
| III-14 | 20 | balance | 1 | 8 | TiC | 1.2 | 2.5 | 0.73 |
| | | | | | $Cr_3C_2$ | 1.5 | 1.5 | |
| | | | | | ZrC | 1.5 | 1.0 | |
| III-15 | 10 | balance | 1 | 10 | $Cr_3C_2$ | 1.5 | 1 | 0.58 |
| | | | | | VC | 1.0 | 0.5 | |
| III-16 | 10 | balance | 1 | 8 | $Cr_3C_2$ | 1.5 | 1 | 0.58 |
| | | | | | Ni | 1.0 | 2 | |

Samples marked '*' are out of the scope of the present invention.

[1)]Particle size distribution of mixed powder after a powder mixing step, D50 value (μm) of Microtrac analysis.

To the slurry, 1.6 mass % of paraffin wax as an organic binder was added, followed by mixing and further drying in a nitrogen gas atmosphere using a spray drying method to obtain granules. Using the granules, predetermined numbers of green compacts having a shape of a cutting tool and those having a shape of a test piece for a transverse test were produced by die press forming. Then, each green compact was heated at a temperature raising rate of 6° C./minute in the heating atmosphere shown in Table 5, sintered while maintaining at the temperature in the atmosphere shown in Table 5, cooled to 1,000° C. or lower at the temperature-fall rate shown in Table 5 in a nitrogen gas atmosphere, and then cooled to room temperature to produce cemented carbides (sample Nos. III-1 to III-16 in Tables 4 and 5).

TABLE 5

| | Sintering conditions | | | | |
|---|---|---|---|---|---|
| Sample No. | Heating atmosphere | Sintering atmosphere | Temperature (° C.) | Time (hour) | Cooling rate (°C./minute) |
| III-1 | Vacuum (<0.4 kPa) | Autogeneous atmosphere (1 kPa) | 1380 | 2 | 80 |
| III-2 | Vacuum (<0.4 Pa) | Autogeneous atmosphere (50 kPa) | 1400 | 2 | 200 |
| III-3 | Vacuum (<0.4 Pa) | Autogeneous atmosphere (5 kPa) | 1415 | 1.5 | 50 |
| III-4 | Vacuum (<0.4 Pa) | Autogeneous atmosphere (10 kPa) | 1410 | 1 | 150 |
| III-5 | Vacuum (<0.4 Pa) | Autogeneous atmosphere (10 kPa) | 1380 | 2 | 250 |
| *III-6 | Vacuum (<0.4 Pa) | Vacuum (<0.4 Pa) | 1430 | 2 | 100 |
| *III-7 | $N_2$ gas flow (1 kPa) | Autogeneous atmosphere (1.5 kPa) | 1415 | 1 | 40 |
| *III-8 | Vacuum (<0.4 kPa) | $N_2$ gas flow (0.8 kPa) | 1410 | 1 | 150 |
| *III-9 | Vacuum (<0.4 kPa) | Autogeneous atmosphere (2 kPa) | 1350 | 1.5 | 100 |
| *III-10 | Vacuum (<0.4 kPa) | Autogeneous atmosphere (2 kPa) | 1350 | 1.5 | 100 |

TABLE 5-continued

| Sample No. | Sintering conditions: Heating atmosphere | Sintering atmosphere | Temperature (° C.) | Time (hour) | Cooling rate (°C./minute) |
|---|---|---|---|---|---|
| III-11 | Vacuum (<0.4 kPa) | Autogeneous atmosphere (1 kPa) | 1380 | 2 | 80 |
| III-12 | Vacuum (<0.4 Pa) | Autogeneous atmosphere (50 kPa) | 1400 | 2 | 200 |
| III-13 | Vacuum (<0.4 Pa) | Autogeneous atmosphere (5 kPa) | 1415 | 1.5 | 50 |
| III-14 | Vacuum (<0.4 Pa) | Autogeneous atmosphere (10 kPa) | 1410 | 1 | 150 |
| III-15 | Vacuum (<0.4 Pa) | Autogeneous atmosphere (10 kPa) | 1320 | 1 | 200 |
| III-16 | Vacuum (<0.4 Pa) | Autogeneous atmosphere (10 kPa) | 1320 | 1 | 200 |

Samples marked '*' are out of the scope of the present invention.
[1)]Particle size distribution of mixed powder after a powder mixing step, D50 value (μm) of Microtrac analysis.

With respect to the surface of the resulting cemented carbide, X-ray diffraction was carried out and each diffraction peak intensity in a X-ray diffraction pattern was determined, and then the above peak intensity ratio $[I_{Co}/(I_{WC}+I_{Co})]$ was calculated. Using X-ray photoelectron spectroscopy (XPS), concentration distribution in a depth direction of Co in the zone including the vicinity of the surface of a cross section of the cemented carbide was measured and the thickness of the zone in which the concentration of Co is higher as compared with the inside of the cemented carbide was measured as the thickness of the binder-phase-riched layer. With respect to the sample in which the binder-phase-riched layer exists, presence or absence of binder-phase-aggregated portions and properties were evaluated in the same manner as in Example 1. The results are shown in Tables 6 and 7.

Furthermore, machinability was evaluated under the following conditions.

<Cutting Conditions>

Work Material: $Ti_6Al_4V$ Alloy

Cutting Speed: 100 m/minute

Feed Rate: 0.5 mm/rev

Depth of Cut: 2 mm

Others: Wet Cutting

Evaluation Method: Evaluation was terminated at the stage where worked surface roughness (Maximum height Rz) exceeds 0.8 μm or chipping and fractures have occurred, and the number of work materials which could be cut was compared. Cutting tool samples (10 samples each) were evaluated and an average value was calculated. The results are shown in Table 7.

<Transverse Test Conditions>

Test Piece Size: 8 mm×4 mm×24 mm

Chamfering: 0.2 mm ~45°

Test Method: Three-Point Bending (Distance between Supporting Points: 20±0.5)

Test Load: A load of 800 N or less was applied and the load at breakage was taken as a maximum load. Cutting tool samples (10 samples each) produced by the same method were evaluated and an average value was calculated. The results are shown in Table 7.

TABLE 6

| Sample No. | Thickness of binder phase riched layer (μm) | $I_{co}/(I_{WC}+I_{Co})$ | $T_{cs}/T_{ci}$ | Oxygen content (mass %) | Mean particle size of WC particle (μm) |
|---|---|---|---|---|---|
| III-1 | 0.5 | 0.03 | 1.56 | 0.043 | 0.61 |
| III-2 | 1.1 | 0.05 | 1.64 | 0.045 | 0.95 |
| III-3 | 1.4 | 0.11 | 1.89 | 0.051 | 0.97 |
| III-4 | 2.4 | 0.25 | 2.54 | 0.045 | 0.65 |
| III-5 | 4.8 | 0.32 | 5.42 | 0.064 | 0.74 |
| *III-6 | 0 | 0.01 | 1.74 | 0.074 | 0.57 |
| *III-7 | 5.2 | 0.35 | 5.13 | 0.068 | 0.84 |
| *III-8 | 60 | 0.76 | 4.86 | 0.071 | 1.24 |
| *III-9 | 80 | 1.54 | 8.45 | 0.073 | 0.96 |
| *III-10 | 85 | 0.61 | 5.93 | 0.050 | 0.84 |
| III-11 | 0.7 | 0.05 | 1.49 | 0.028 | 0.62 |
| III-12 | 1.2 | 0.09 | 1.73 | 0.032 | 0.83 |
| III-13 | 1.6 | 0.17 | 1.91 | 0.039 | 0.89 |
| III-14 | 2.1 | 0.2 | 2.24 | 0.051 | 0.87 |
| III-15 | 4.5 | 0.45 | 5.38 | 0.032 | 0.60 |
| III-16 | 3.8 | 0.42 | 5.13 | 0.05 | 0.57 |

Samples marked '*' are out of the scope of the present invention.

TABLE 7

| Sample No. | Binder-phase-aggregated portions: Existing ratio (area %) | Mean particle size (μm) | Aggregated portion/Normal portion[1)] | Number of work materials | Flexural strength (MPa) |
|---|---|---|---|---|---|
| III-1 | 35 | 120 | 5.0 | 59 | 2100 |
| III-2 | 40 | 140 | 4.4 | 64 | 2380 |
| III-3 | 40 | 140 | 5.0 | 67 | 2500 |
| III-4 | 53 | 150 | 5.3 | 75 | 3000 |
| III-5 | 58 | 130 | 4.5 | 69 | 3400 |
| *III-6 | — | — | — | 9 | 1790 |
| *III-7 | 6 | 80 | 0.7 | 29 | 1930 |
| *III-8 | 7 | 100 | 0.8 | 21 | 2010 |
| *III-9 | 90 | 460 | 6.4 | 18 | 2500 |
| *III-10 | 85 | 290 | 6.1 | 34 | 2500 |
| III-11 | 70 | 160 | 8.8 | 83 | 2350 |
| III-12 | 80 | 200 | 10.0 | 98 | 2500 |
| III-13 | 80 | 200 | 10.0 | 93 | 2600 |
| III-14 | 70 | 170 | 7.8 | 88 | 3300 |
| III-15 | 65 | 150 | 5.4 | 71 | 3700 |
| III-16 | 50 | 140 | 5.0 | 63 | 3300 |

Samples marked '*' are out of the scope of the present invention.

[1)]Aggregated portion/Normal portion: Total content of binder phase (Co + Ni) in aggregated portion/Total content of binder phase (Co + Ni) in normal portion on the surface of cemented carbide.

As is apparent from the results shown in Tables 4 to 7, in the sample No. III-6 in which the cemented carbide was sintered in a vacuum atmosphere, no binder-phase-riched layer was formed, whereas, in the sample No. III-7 in which a nitrogen ($N_2$) gas was allowed to flow and the cooling rate after sintering was less than 50° C./minute and the sample No. III-8 in which a nitrogen ($N_2$) gas was allowed to flow during sintering, a binder-phase-riched layer having a thickness of more than 5 μm was formed. Also, in the samples No. III-9 and No. III-10 in which the Co content exceeds 10 mass %, $I_{Co}/(I_{WC}+I_{Co})$ exceeded 0.5. These samples (Nos. III-6 to III-10) showed smaller number of work materials and shorter tool life as compared with the samples Nos. III-1 to III-5 and samples Nos. III-11 to III-16. Also, the flexural strength tends to decrease.

On the other hand, all samples No. III-1 to III-5 and samples No. III-11 to III-16, in which the Co content was 5 to 10 mass %, the thickness of the binder-phase-riched layer was 0.1 to 5 μm and $0.02 \leqq I_{Co}/(I_{WC}+I_{Co}) \leqq 0.5$ in accordance with the present invention, showed long tool life. Particularly, in the samples No. III-11 to III-13 and III-15 in which a WC raw powder having a mean particle size of 5 to 100 μm was used and the particle size of the powder was adjusted during powder mixing, and thus the content of oxygen in the cemented carbide became 0.045 mass % or less, flexural strength was excellent and also the number of work materials increased as compared with the same composition of the samples No. III-1 to III-3 and III-5. Particularly, in the samples Nos. III-11 to III-13, it was confirmed that, regardless of such a low content of Co as 5 to 7 mass %, it is possible to sinter at such a low temperature as 1,380 to 1,415° C. and excellent flexural strength and machinability were exhibited without causing the growth of tungsten carbide particles in the cemented carbide.

Example IV

<Production of Cemented Carbide>

A tungsten carbide (WC) powder, a cobalt (Co) powder and other carbide powders, each having the mean particle size shown in Table 8, was mixed in the proportion shown in Table 8 and 1.6 mass % of paraffin wax as an organic binder and methanol as a solvent were added. Furthermore, the mixed powder was ground until the particle size becomes a D50 value as measured by a Microtrac method shown in Table 8, and then granulated. Subsequently, the granulated mixed raw material was subjected to die press forming, heated to the temperature shown in Table 8 at a temperature raising rate of 6° C./minute, sintered while maintaining at the temperature in the sintered atmosphere shown in Table 8 for 1 hour, and then cooled to room temperature at 300° C./minute to obtain cemented carbides (samples Nos. IV-1 to IV-13 in Table 8).

TABLE 8

| Sample No. | Composition of primary raw materials (mass %): Mean particle size of WC (μm) | WC | Other carbides | | Co | Sintering conditions: Sintering temperature (° C.) | Sintering atmosphere |
|---|---|---|---|---|---|---|---|
| IV-1 | 8 | 93.5 | $Cr_3C_2$<br>VC | 0.5<br>0.1 | 6 | 1400 | Autogeneous atmosphere |
| IV-2 | 10 | 91.4 | $Cr_3C_2$<br>TaC | 1.7<br>0.1 | 7 | 1375 | Autogeneous atmosphere |
| IV-3 | 9 | 94.9 | $Cr_3C_2$ | 0.1 | 6 | 1400 | Autogeneous atmosphere |
| IV-4 | 11 | 93.2 | $Cr_3C_2$ | 0.8 | 6 | 1350 | Autogeneous atmosphere |
| IV-5 | 12 | 94.4 | $Cr_3C_2$<br>VC | 0.55<br>0.05 | 5 | 1400 | Autogeneous atmosphere |
| IV-6 | 7 | 94.4 | $Cr_3C_2$<br>VC | 0.45<br>0.15 | 5 | 1425 | Autogeneous atmosphere |

TABLE 8-continued

| Sample No. | Composition of primary raw materials (mass %) | | | | | Sintering conditions | |
|---|---|---|---|---|---|---|---|
| | Mean particle size of WC (μm) | WC | Other carbides | | Co | Sintering temperature (° C.) | Sintering atmosphere |
| *IV-7 | 1 | 95.6 | $Cr_3C_2$ | 0.4 | 4 | 1400 | Autogeneous atmosphere |
| *IV-8 | 9 | 89.2 | $Cr_3C_2$ | 0.8 | 10 | 1400 | Nitrogen gas flow atmosphere |
| *IV-9 | 0.9 | 91.0 | $Cr_3C_2$<br>VC | 0.9<br>0.1 | 8 | 1425 | Vacuum |
| *IV-10 | 10 | 92.6 | $Cr_3C_2$<br>VC | 1.3<br>0.1 | 6 | 1275 | Vacuum |
| *IV-11 | 0.7 | 92.9 | $Cr_3C_2$ | 0.7 | 7 | 1425 | Autogeneous atmosphere |
| *IV-12 | 11 | 93.4 | $Cr_3C_2$<br>VC | 1.5<br>0.1 | 5 | 1450 | Nitrogen gas flow atmosphere |
| *IV-13 | 10 | 92.9 | $Cr_3C_2$<br>VC | 2.0<br>0.1 | 5 | 1600 | Autogeneous atmosphere |

Samples marked '*' are out of the scope of the present invention.

With respect to the resulting cemented carbides, a coercive force and saturation magnetization were measured using a coercive force measuring apparatus ("KOERZIMAT CS" manufactured by FOERSTER JAPAN Limited). Also, the content of oxygen in the cemented carbide was measured by the following procedure. Namely, the ground cemented carbide powder sample was mixed with nickel and tin (Sn) powders and the sample was decomposed by heating to a temperature within a range from 1,000 to 2,000° C., and then oxygen was detected and quantitatively determined using an infrared detector. Furthermore, in accordance with a method for measuring a mean particle size of a cemented carbide defined in CIS-019D-2005, the mean particle size of a hard phase in the cemented carbide was measured. With respect to the samples in which the binder-phase-riched layer exists, presence or absence of binder-phase-aggregated portions and properties were evaluated in the same manner as in Example 1. The results are shown in Table 9. "Hc" in Table 9 means a coercive force, while "4πσ" means saturation magnetization.

TABLE 9

| Sample No. | Characteristics of sintered body | | | |
|---|---|---|---|---|
| | Mean particle size of WC (μm) | Oxygen content (mass %) | Hc (kA/m) | 4πσ ($\mu Tm^3/kg$) |
| IV-1 | 0.6 | 0.035 | 25 | 10.5 |
| IV-2 | 0.87 | 0.03 | 18 | 11.1 |
| IV-3 | 0.81 | 0.028 | 21 | 10.2 |
| IV-4 | 1.0 | 0.034 | 15 | 12.0 |
| IV-5 | 0.85 | 0.037 | 19 | 9.9 |
| IV-6 | 0.66 | 0.045 | 22 | 9.0 |
| *IV-7 | 0.89 | 0.053 | 20 | 7.8 |
| *IV-8 | 0.97 | 0.048 | 12 | 12.4 |
| *IV-9 | 0.72 | 0.055 | 23 | 11.9 |
| *IV-10 | 0.40 | 0.039 | 30 | 10.7 |
| *IV-11 | 1.0 | 0.061 | 10 | 11.8 |
| *IV-12 | 0.45 | 0.038 | 23 | 8.7 |
| *IV-13 | 1.3 | 0.047 | 19 | 9.8 |

Samples marked '*' are out of the scope of the present invention.

Also, machinability was evaluated under the following conditions. The results are shown in Table 10.

<Cutting Conditions>

(Wear Resistance Test)

Work Material: $Ti_6Al_4V$ Alloy Round Bar

Cutting speed: 150 m/minute

Feed Rate: 0.3 mm/rev

Depth of Cut: 1.5 mm

Others: Wet Cutting

Evaluation Method: A nose wear width was measured in case of cutting for 20 minutes. In case of being damaged during cutting, the test was terminated at that stage.

(Fracture Resistance Test)

Work Material: $Ti_6Al_4V$ Alloy Round Bar with Four Grooves

Cutting Speed: 120 m/minute

Feed Rate: 0.3 mm

Depth of Cut: 2.0 mm

Others: Wet Cutting

Evaluation method: The number of impacts experienced on the cutting edge when the cutting edge was damaged was measured.

TABLE 10

| Sample No. | Binder-phase-aggregated portions | | | Machinability | |
|---|---|---|---|---|---|
| | Existing ratio (area %) | Mean particle size (μm) | Aggregated portion/Normal portion[1)] | Wear width (mm) | Number of impacts (times) |
| IV-1 | 35 | 140 | 4.4 | 0.11 | 3800 |
| IV-2 | 35 | 130 | 3.9 | 0.18 | 4000 |
| IV-3 | 45 | 150 | 5.0 | 0.13 | 5500 |
| IV-4 | 40 | 200 | 5.0 | 0.21 | 5000 |
| IV-5 | 40 | 160 | 6.7 | 0.18 | 4700 |
| IV-6 | 30 | 100 | 5.0 | 0.09 | 3600 |
| *IV-7 | 8 | 35 | 1.6 | damaged | 1000 |
| *IV-8 | 9 | 40 | 0.8 | 0.48 | 4100 |
| *IV-9 | 75 | 450 | 8.3 | 0.41 | 3800 |
| *IV-10 | 100 | — | — | damaged | 1000 |
| *IV-11 | 71 | 300 | 7.9 | 0.45 | 1800 |
| *IV-12 | 9 | 20 | 1.5 | damaged | 1000 |
| *IV-13 | 9 | 20 | 1.3 | 0.58 | 1200 |

Samples marked '*' are out of the scope of the present invention.

[1)]Aggregated portion/Normal portion: Total content of binder phase (Co + Ni) in aggregated portion/Total content of binder phase (Co + Ni) in normal portion on the surface of cemented carbide.

As is apparent from the results shown in Table 8, Table 9 and Table 10, in the samples Nos. IV-7, IV-9 and IV-11 in which a raw power whose mean particle size is not within a range from 5 to 200 μm, the oxygen content exceeded 0.045 mass % and both wear resistance and fracture resistance became worse. In the samples Nos. IV-8 and IV-9 in which the Co content exceeds 7 mass %, wear resistance deteriorated and, in the sample No. IV-7 in which the Co content is less than 5 mass %, the samples were damaged in the early stage. Furthermore, in the samples Nos. IV-10 and IV-12 in which the sintered atmosphere is a vacuum or nitrogen gas flow atmosphere and the mean particle size of the hard phase decreased to the value less than 0.6 μm, the samples were damaged in the early stage and, in the sample No. IV-13 in which the mean particle size of the hard phase increased to the value more than 1.0 μm, wear resistance deteriorated. Also, in the samples Nos. IV-8 and IV-11 in which the coercive force is less than 15 kA/m, wear resistance deteriorated and, in the sample No. IV-10 in which the coercive force exceeds 25 kA/m, fracture resistance deteriorated. Furthermore, in the sample Nos. IV-7 and IV-12 in which saturation magnetization is less than 9 $\mu Tm^3/kg$, fracture resistance deteriorated and, in the sample No. IV-8 in which saturation magnetization exceeds 12 $\mu Tm^3/kg$, wear resistance deteriorated.

On the other hand, the samples No. IV-1 to IV-6 having characteristics within the scope of the present invention were excellent in both wear resistance and fracture resistance and showed very excellent tool life.

Example V

On each surface of cemented carbides of the sample No. IV-1 and the sample No. IV-7 shown in Tables 8 to 10, a (Ti,Al) N coating having a thickness of 1.5 μm was formed by an arc ion plating method to obtain the sample No. V-1 and the sample No. V-2. With respect to the sample thus obtained, machinability was evaluated under the following conditions. The results are shown in Table 11.

<Cutting Conditions>

(Wear Resistance Test)

Work Material: Inconel 718 Round Bar

Cutting Speed: 180 m/minute

Feed Rate: 0.3 mm/rev

Depth of cut: 1.0 mm

Others: Wet Cutting

Evaluation Method: A nose wear width was measured in case of cutting for 20 minutes. In case of being damaged during cutting, the test was terminated at that stage.

(Fracture Resistance Test)

Work Material: Inconel 718 Round Bar with Four Grooves

Cutting Speed: 150 m/minute

Feed Rate: 0.3 mm

Depth of Cut: 2.0 mm

Others: Wet Cutting

Evaluation method: The number of impacts experienced on the cutting edge when the cutting edge was damaged was measured.

TABLE 11

| | Machinability | |
|---|---|---|
| Sample No. | Wear width (mm) | Number of impacts (times) |
| V-1 | 0.14 | 4500 |
| *V-2 | damaged | 800 |

Samples marked '*' are out of the scope of the present invention.

As is apparent from the results shown in Table 11, the sample No. V-2, which is not within the scope of the present invention, was damaged in the early stage in the fracture resistance test and also damaged in the wear resistance test because of insufficient strength. To the contrary, the sample No. V-1, which is within the scope of the present invention, exhibited excellent wear resistance and fracture resistance and thus a long tool life cutting tool was obtained.

The invention claimed is:

1. A cemented carbide comprising:

5 to 10 mass % of cobalt and/or nickel;

0 to 10 mass % of at least one selected from a carbide except for tungsten carbide, a nitride and a carbonitride of at least one selected from the group consisting of metals of groups 4, 5 and 6 of the Periodic Table; and the balanced amount of tungsten carbide, a hard phase comprising mainly tungsten carbide particles, and containing β particles of at least one selected from the carbide, the nitride and the carbonitride, and the hard phase being bonded through a binder phase comprising mainly cobalt and/or nickel, wherein a mean particle size of the tungsten carbide particles is 1 μm or less, and the cemented carbide having a sea-island structure in which plural binder-phase-aggregated portions comprising mainly cobalt and/or nickel are scattered in the proportion of 10 to 70 area % relative to the total area on the surface of the cemented carbide, and wherein a ratio of the total content m1 of cobalt and nickel in the binder-phase-aggregated portions to the total content m2 of cobalt and nickel in a normal portion other than the binder-phase-aggregated portions, (m1/m2), is 2 to 10.

2. The cemented carbide according to claim 1, wherein the total content of cobalt and nickel on the surface of the cemented carbide is 15 to 70 mass % relative to the total amount of the metal elements on the surface of the cemented carbide.

3. A cemented carbide comprising:

5 to 10 mass % of cobalt and/or nickel;

0 to 10 mass % of at least one selected from a carbide except for tungsten carbide, a nitride and a carbonitride of at least one selected from the group consisting of metals of groups 4, 5 and 6 of the Periodic Table; and the balanced amount of tungsten carbide, a hard phase comprising mainly tungsten carbide particles, and containing β particles of at least one selected from the carbide, the nitride and the carbonitride, and the hard phase being bonded through a binder phase comprising mainly cobalt and/or nickel, wherein a mean particle size of the tungsten carbide particles is 1 μm or less, and the cemented carbide having a sea-island structure in which plural binder-phase-aggregated portions comprising mainly cobalt and/or nickel are scattered in the proportion of 10 to 70 area % relative to the total area on the surface of the cemented carbide, and wherein a mean diameter of the binder-phase-aggregated portions is 10 to 300 μm when seeing from the cemented carbide from the surface.

4. The cemented carbide according to claim 3, wherein the binder-phase-aggregated portions exist in the depth zone extending from the surface of the cemented carbide to 5 μm depth.

5. The cemented carbide according to claim 3, which contains chromium and/or vanadium.

6. The cemented carbide according to claim 3, wherein a hard coating is coated on the surface of the cemented carbide.

* * * * *